US006473004B1

(12) United States Patent
Smull

(10) Patent No.: US 6,473,004 B1
(45) Date of Patent: Oct. 29, 2002

(54) BILGE PUMP MONITOR AND ALERT SYSTEM FOR BOATS AND OTHER VESSELS

(76) Inventor: Lester C. Smull, 17631 Finch, Irvine, CA (US) 92614

( * ) Notice: Subject to any disclaimer, the term of this patent is extended or adjusted under 35 U.S.C. 154(b) by 0 days.

(21) Appl. No.: 09/658,804

(22) Filed: Sep. 11, 2000

(51) Int. Cl.[7] ..... G08B 23/00
(52) U.S. Cl. ..... 340/984; 114/183 R; 417/63
(58) Field of Search ..... 340/984; 73/307; 114/183 R; 116/26; 415/118; 417/63, 2, 12; 701/21

(56) References Cited

U.S. PATENT DOCUMENTS 4,341,178 A * 7/1982 Price ..... 114/183 R
4,697,535 A * 10/1987 Wileman, III ..... 114/183 R
4,804,936 A * 2/1989 Sale ..... 338/80
5,078,577 A * 1/1992 Heckman ..... 417/2
5,576,582 A * 11/1996 White ..... 417/36
5,642,053 A * 6/1997 Heckman ..... 324/708

* cited by examiner

*Primary Examiner*—Brent A. Swarthout
(74) *Attorney, Agent, or Firm*—Roy A. Ekstrand

(57) ABSTRACT

A control unit is supported within a host boat or other vessel and is operatively coupled to a display unit supported within the pilot house of the boat or vessel. The display unit includes a display panel having a plurality of illuminatable membrane switches formed on a membrane switch panel. A plurality of bilge pumps are supported within the bilge compartments of the host boat or vessel and are coupled to the control unit to provide operating signal information. A corresponding plurality of high water level alarm switches are supported within each of the bilge compartments and are also operatively coupled to the control unit. The control unit is operatively coupled to an alarm interface which operates a plurality of alarm devices including one or more audible alarms, a telephone auto dialer and a strobe light unit. The microprocessor controlled system within the control unit and/or the display unit may be programmed by the user to establish the desired operational limits of pump cycle time and pump cycle numbers forming the alarm limits for each of the bilge compartments. The system stores data indicative of the history of operation of each bilge pump which is available to the operator upon inquiry.

17 Claims, 25 Drawing Sheets

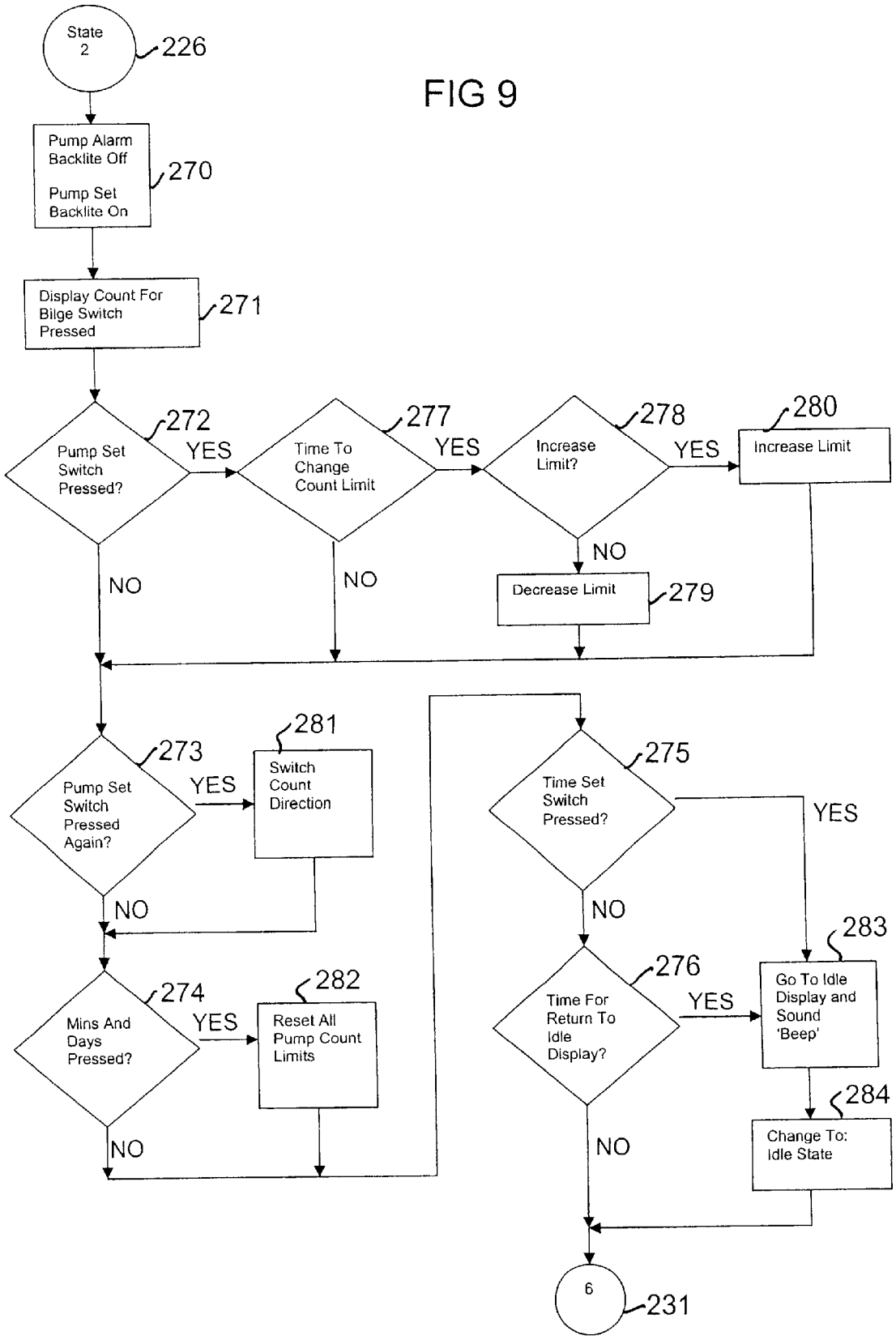
State 2
226
FIG 9
Pump Alarm Backlite Off
Pump Set Backlite On
270
Display Count For Bilge Switch Pressed
271
Pump Set Switch Pressed?
272
YES
NO
Time To Change Count Limit
277
YES
NO
Increase Limit?
278
YES
NO
Increase Limit
280
Decrease Limit
279
Pump Set Switch Pressed Again?
273
YES
NO
Switch Count Direction
281
Mins And Days Pressed?
274
YES
NO
Reset All Pump Count Limits
282
Time Set Switch Pressed?
275
YES
NO
Time For Return To Idle Display?
276
YES
NO
Go To Idle Display and Sound 'Beep'
283
Change To: Idle State
284
6
231

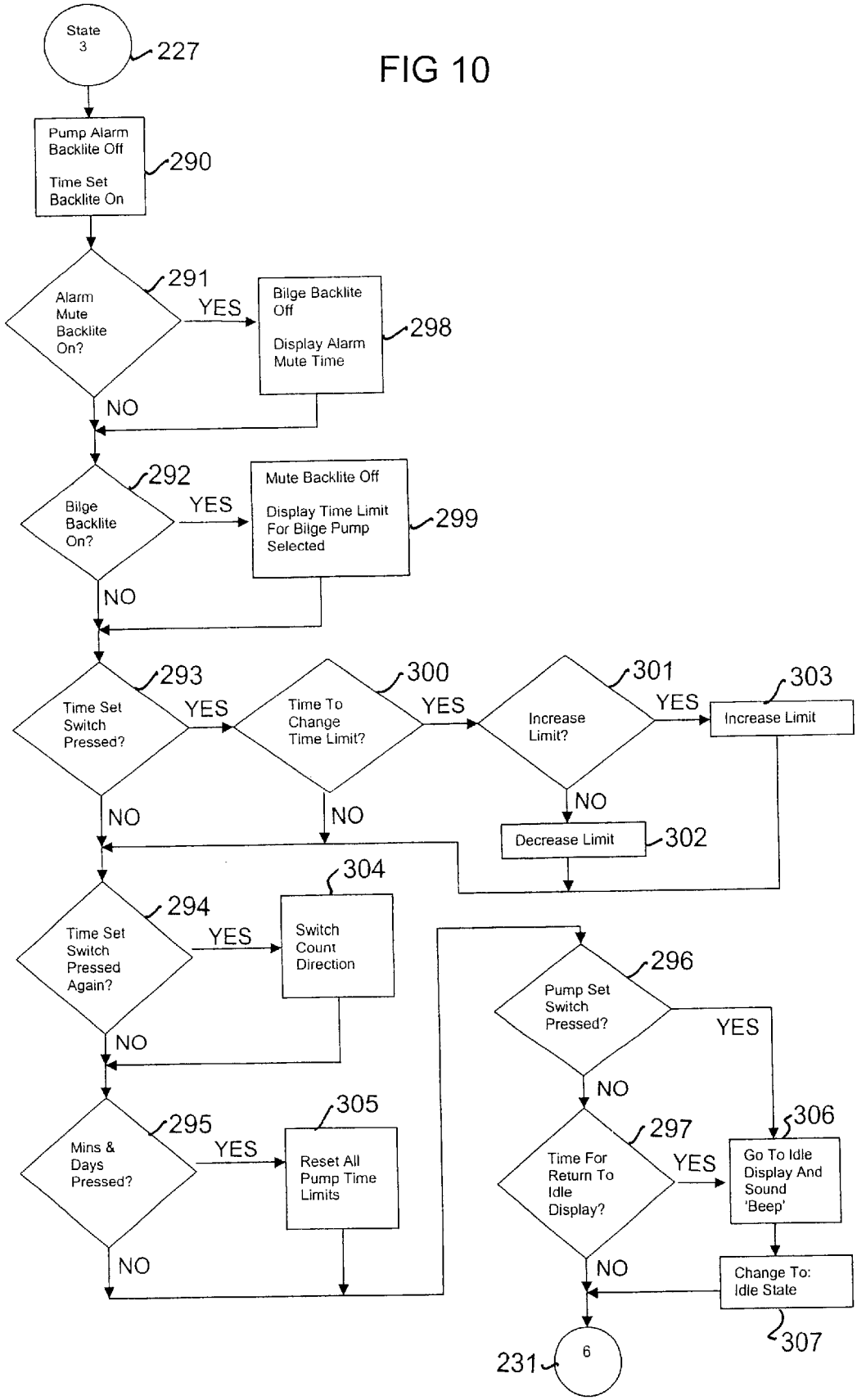
State 3
227
FIG 10
Pump Alarm Backlite Off
Time Set Backlite On
290
Alarm Mute Backlite On?
291
YES
Bilge Backlite Off
Display Alarm Mute Time
298
NO
Bilge Backlite On?
292
YES
Mute Backlite Off
Display Time Limit For Bilge Pump Selected
299
NO
Time Set Switch Pressed?
293
YES
Time To Change Time Limit?
300
YES
Increase Limit?
301
YES
Increase Limit
303
NO
NO
NO
Decrease Limit
302
Time Set Switch Pressed Again?
294
YES
Switch Count Direction
304
NO
Mins & Days Pressed?
295
YES
Reset All Pump Time Limits
305
NO
Pump Set Switch Pressed?
296
YES
NO
Time For Return To Idle Display?
297
YES
Go To Idle Display And Sound 'Beep'
306
NO
Change To: Idle State
307
6
231

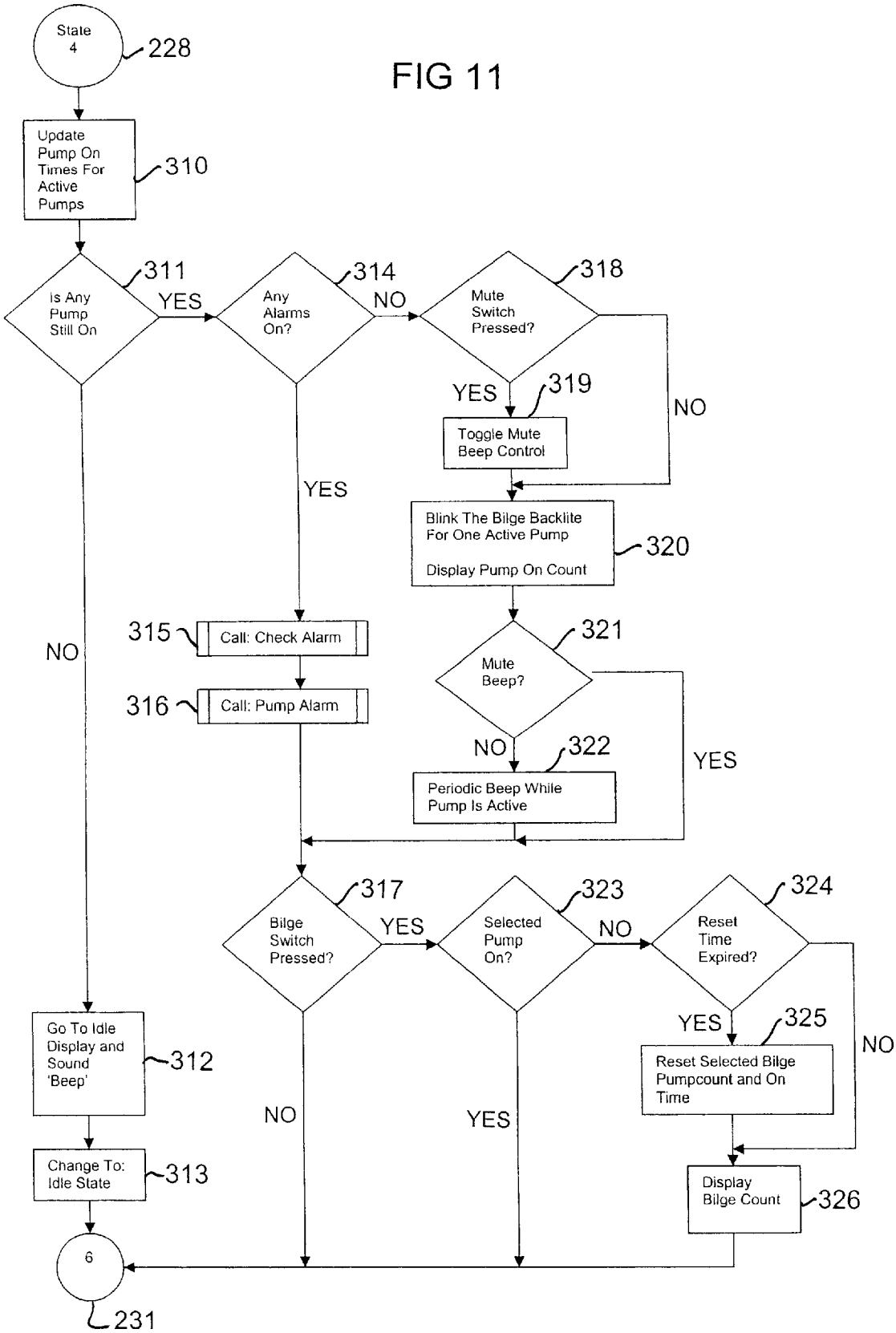
State 4
228
FIG 11
Update Pump On Times For Active Pumps
310
Is Any Pump Still On
311
YES
Any Alarms On?
314
NO
Mute Switch Pressed?
318
YES
319
Toggle Mute Beep Control
NO
YES
Blink The Bilge Backlite For One Active Pump
Display Pump On Count
320
NO
315
Call: Check Alarm
316
Call: Pump Alarm
Mute Beep?
321
NO
322
Periodic Beep While Pump Is Active
YES
Bilge Switch Pressed?
317
YES
Selected Pump On?
323
NO
Reset Time Expired?
324
YES
325
Reset Selected Bilge Pumpcount and On Time
NO
Go To Idle Display and Sound 'Beep'
312
NO
YES
Change To: Idle State
313
Display Bilge Count
326
6
231

FIG 16
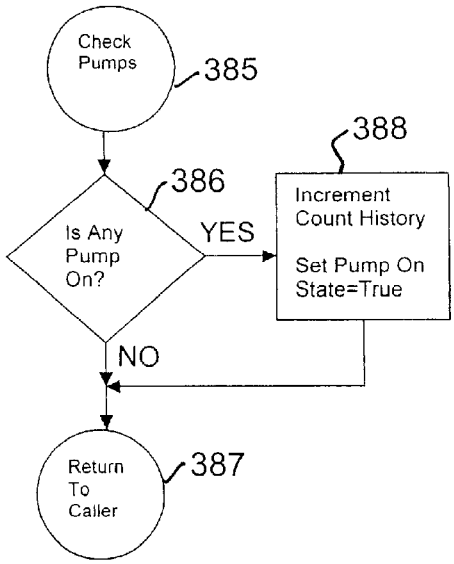
FIG 18
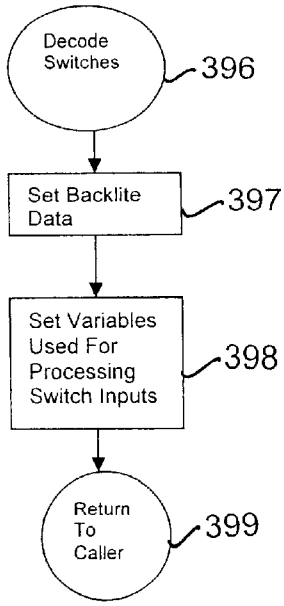
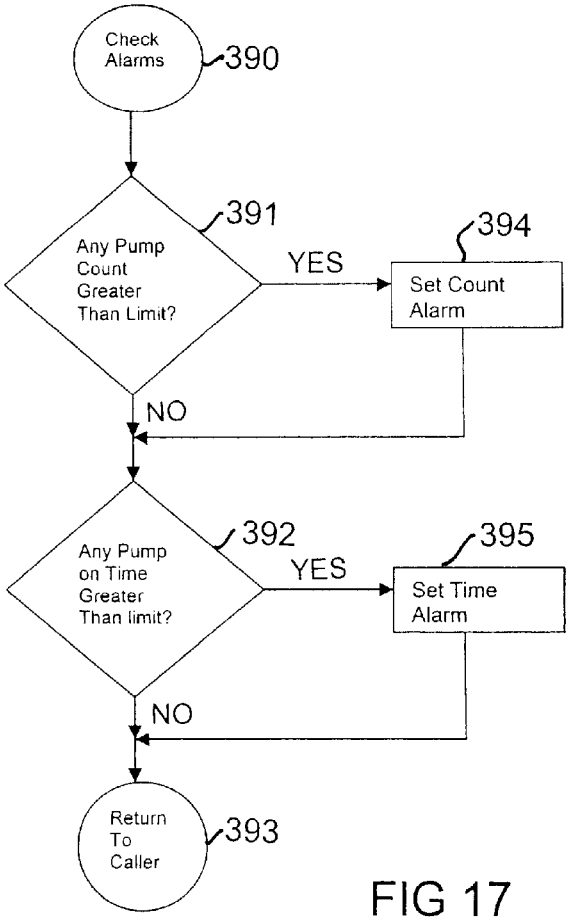
FIG 17

BILGE PUMP MONITOR AND ALERT SYSTEM FOR BOATS AND OTHER VESSELS

FIELD OF THE INVENTION

This invention relates generally to boats and other water craft or vessels and particularly to systems operative to manage and control as well as monitor the operation of bilge pump systems therefore.

BACKGROUND OF THE INVENTION

As is well known, most boats regardless of the material or construction and fabrication thereof have a tendency to take on a certain amount of water when floating in a body of water. The causes for the accumulation of water vary substantially with different types, materials and fabrications of boats. However, generally speaking, such causes of water intrusion into the hulls of boats include seepage through the hull material or joints formed between elements of the hull, leakage or small flaws in the hull integrity, failures of engine cooling systems and failure of seals utilized with various "through-the-hull" fittings or couplings as well as rain which runs into the bilge.

For the most part, water entering a boat hull tends to accumulate in the lower portion of the hull usually referred to as the "bilge". In smaller boats, the hull interior usually forms a single bilge compartment extending generally the length of the hull. However, in larger boats such as large yachts and pleasure craft, the hull is typically divided into a plurality of sections or compartments. These multiple compartments divide the bilge portion of the hull interior into a corresponding plurality of bilge compartments usually identified by their location within the ship such as "bow bilge", "stern bilge", "engine room bilge" and so on. In most larger boats, these bilge compartments are separated by water tight bulkheads and doors to protect the overall buoyancy of the vessel in the event of a significant leak or damage to the hull.

While small amounts of water within the bilge compartments of a boat is a tolerable and generally common condition, extensive water collection within one or more bilge compartments of a boat hull is extremely undesirable and may if left unattended prove dangerous or even catastrophic. To accommodate and compensate for this general tendency of boats to take on water and the risk of excess water entering the bilge due to causes such as seal failure or engine cooling system failure, practitioners in the art typically provide one or more bilge pumps operative to pump excess water from the bilge interior.

The basic principle of a bilge pump system is relatively simple and direct. For the most part, bilge pump systems utilize submersible battery-powered pumps positioned within each of the bilge compartments. Water level sensors such as float switches or the like are operatively coupled to each pump and function to initiate pump operation in response to water levels within the bilge compartment beyond a predetermined level. As the pump operates, water within the bilge is pumped and discharged outwardly through coupling lines to a discharge port outside the boat hull.

Notwithstanding, the simplicity and directness of action exercised by basic bilge pump systems, the implementation of an effective and practical bilge pump system is subject to several levels of complexity and several limitations. Much of this complexity and limitation arises as a result of the environment and circumstance of boat usage. For the most part, the majority of boats rest idle in their berths or moorings for extended periods of time between relatively brief intervals of use. Typically, this idle time is largely unattended as the boat operator or owner is away from the boat. This circumstance leaves the boat virtually dependent upon the reliability and proper operation of the bilge pump system within the boat. In the event of a significant failure within the bilge pump system, an unattended boat is subject to a substantial potential for damage or even sinking. In the event of a substantial failure of one or more of the pumps operative within a bilge pump system, even a relatively slow leak may cause substantial damage to a boat.

Faced with the need for protecting boats from damage or loss caused by bilge pump failures or inability to respond to excess water collecting within the boat hull, practitioners in the art have provided various alarm and monitoring equipment for use in combination with bilge pump systems. While such systems vary, the overall objective thereof is to provide a type of warning or alarm for indicating a failure of the bilge pump system and/or the accumulation of a potentially damaging amount of water within the bilge of the boat. For example, U.S. Pat. No. 5,357,247 issued to Marnel et al. sets forth a METHOD AND EQUIPTMENT FOR ALERTING OF DANGEROUS WATER LEVELS which function to alert a boat owner, whether on board or at a remote location, to the fact that the water level within the craft has risen above a predetermined level and at a rate which is causing the water level to increase. The system utilizes a continuity board and a power source which when activated completes a circuit to energize onboard alerting devices such as strobe lights as well as a preprogrammed cellular telephone auto dialer and answering machine. The cellular telephone auto dialer and answering machine dials a given sequence of telephone numbers in response to the detection of an alarm condition. Thus, as water level increases, the audible alarm and strobe lights are energized to provide an indication of a problem. In addition, the cellular telephone auto dialer further operates to contact the boat owner at a predetermined remote telephone.

British patent 2,139,793 issued to Ross et al. sets forth an AUTOMATIC BILGE PUMP MONITOR which includes means for energizing and de-energizing a bilge pump in response to sensed water level. The automatic bilge pump monitor further includes an alarm means arranged to provide a warning in the event the bilge pump has been continuously operating in excess of a predetermined time interval. The bilge pump monitor includes a triggerable monostable timer circuit to provide the time interval monitor function for the system.

While prior art systems such as the above-described bilge pump monitors improve the degree of protection afforded unattended boats against bilge pump failure, they have been found deficient in their inability to provide important information to the person or persons responding to an alarm condition. In order to properly evaluate a bilge pump alarm or failure indication or other indication of excessive water level within the bilge, additional information is needed for a proper response. In addition, there arises a need in the art for a bilge pump monitor and alert system for boats or other vessels which provides diagnostic or analytical data to the boat owner which may be used to avoid the more dramatic alarm producing system failures or conditions.

SUMMARY OF THE INVENTION

Accordingly, it is a general object of the present invention to provide an improved bilge pump monitor and alert system for boats and other vessels. It is a more particular object of the present invention to provide an improved bilge pump monitor and alert system for boats and other vessels which provides the boat owner with diagnostic and analytical data relating to the operating circumstances and conditions of the host system. It is a still more particular object of the present invention to provide an improved bilge pump monitor and alert system for boats and other vessels which maintains a system memory within which a history of system operation and performance is stored together with means for retrieving the stored information and data in a simple and effective manner leading to effective analysis and diagnosis of system operation.

In accordance with the present invention there is provided a bilge pump monitor and alert system for use in a vessel having a plurality of bilge compartments, the system comprising: a plurality of bilge pumps constructed for operation within vessel bilge compartments, the bilge pumps each having means for producing a pump active signal when operating; a plurality of high water switches constructed for operation within vessel bilge compartments, the high water switches each having means for producing a high water level signal when actuated; a control unit coupled to the plurality of bilge pumps and the high water switches receiving pump active signals and the high water level signals; a display unit coupled to the control unit and including a control panel having a plurality of bilge pump buttons, a numeric display, a pump set button and a time set button, the display unit having means for illuminating buttons when pressed; and at least one alarm device, the control unit having means for accumulating and storing the number of times each of the bilge pumps are activated as pump count numbers and for storing the activation time of each of the pumps as pump time numbers and means for establishing a maximum pump count number for each of the bilge pumps and means for establishing a maximum pump activation time number for each of the bilge pumps and having means for activating at least one alarm device when one of the pump count numbers exceeds the maximum pump count number or one of the pump time numbers exceeds the maximum pump time number.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 9 sets forth a flow diagram of the control unit pump counts state portion of the present invention bilge pump monitor and alert system;

FIG. 10 sets forth a flow diagram of the control unit set pump portion of the present invention bilge pump monitor and alert system;

FIG. 11 sets forth a flow diagram of the control unit pump on state portion of the present invention bilge pump monitor and alert system;

FIG. 16 sets forth a flow diagram of the control unit check pump portion of the present invention bilge pump monitor and alert system;

FIG. 17 sets forth a flow diagram of the control unit check alarm sub-routine of the present invention bilge pump monitor and alert system;

FIG. 18 sets forth a flow diagram of the control unit decode switches portion of the present invention bilge pump monitor and alert system;

DESCRIPTION OF THE PREFERRED EMBODIMENTS

Figure 1:
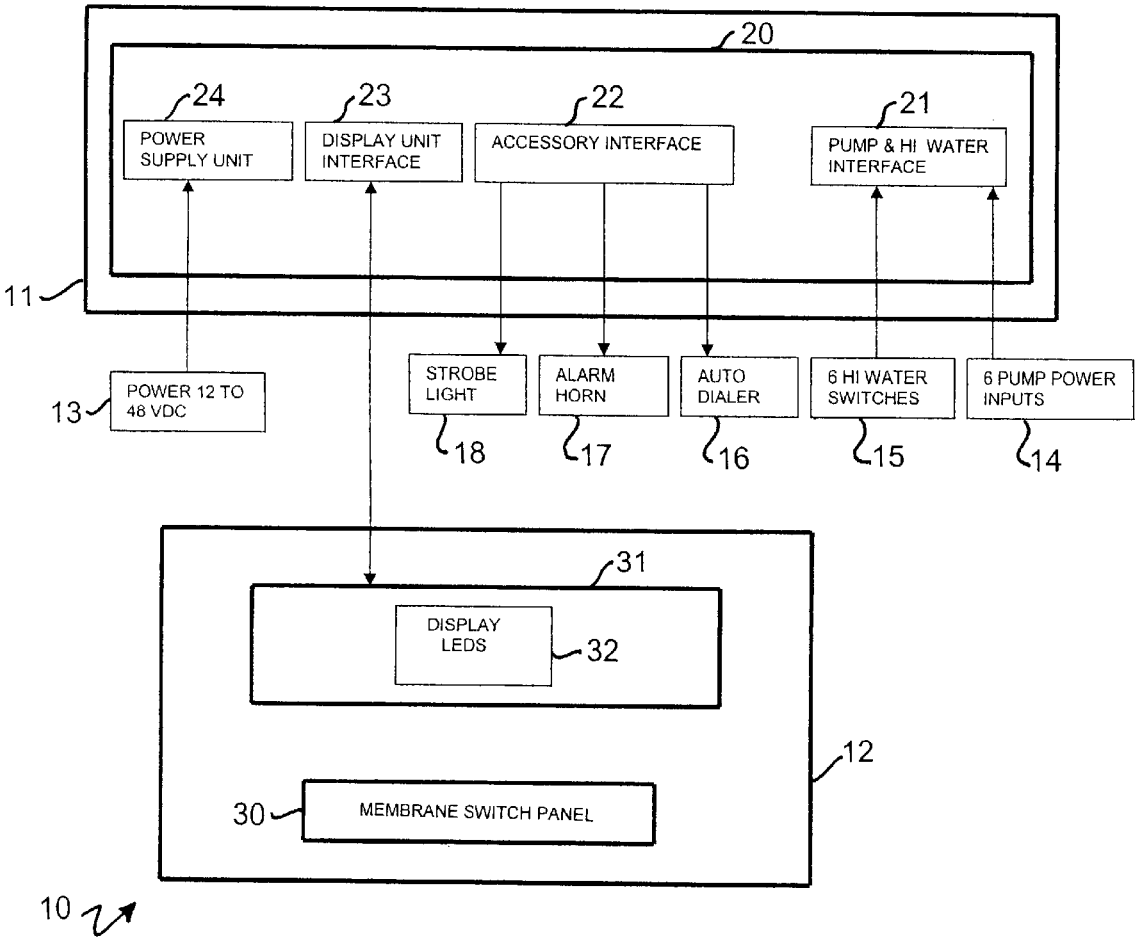
FIG. 1 sets forth a generalized block diagram of a bilge pump monitor and alert system constructed in accordance with the present invention.

FIG. 1 sets forth a generalized block diagram of a bilge pump monitor constructed in accordance with the present invention and generally referenced by numeral 10. Bilge pump monitor 10 is formed of two basic units comprising a control unit 11 and a display unit 12. While the location of control unit 11 within a given boat is a matter of user choice, typically display unit 12, is positioned within the pilot house in order to be readily viewed by and accessible to the operator of the boat.

The structure and operation of control unit 11 and display unit 12 is set forth below in greater detail. However, suffice it to note here, that control unit 11 includes a basic control board 20 having the system set forth in greater detail in FIG. 4A which includes microprocessor 100 and stored memory instructions by which the present invention bilge pump monitor is operated. Thus, control unit 11 includes, in addition to control board 20, a power supply unit 24 operatively coupled to a source of battery power 13. Control unit 11 further includes a plurality of pump sensor and high water input sensor interfaces 21 which in turn are coupled to a plurality of bilge pump power inputs 14 and a plurality of high water switches 15. An accessory interface 22 is operatively coupled to control board 20 and responds to signal conditions provided by control board 20 to actuate one or all of a plurality of alarm devices. In the embodiment of bilge pump monitor 10 set forth in FIG. 1, accessory interface 22 is coupled to an audible alarm such as a horn or siren 16, an automatic telephone dialer 17 and a flashing strobe light unit 18. Audible alarm 16, autodialer 17 and strobe light unit 18 are well known in the art and may be fabricated in accordance with conventional fabrication techniques.

Figure 2:
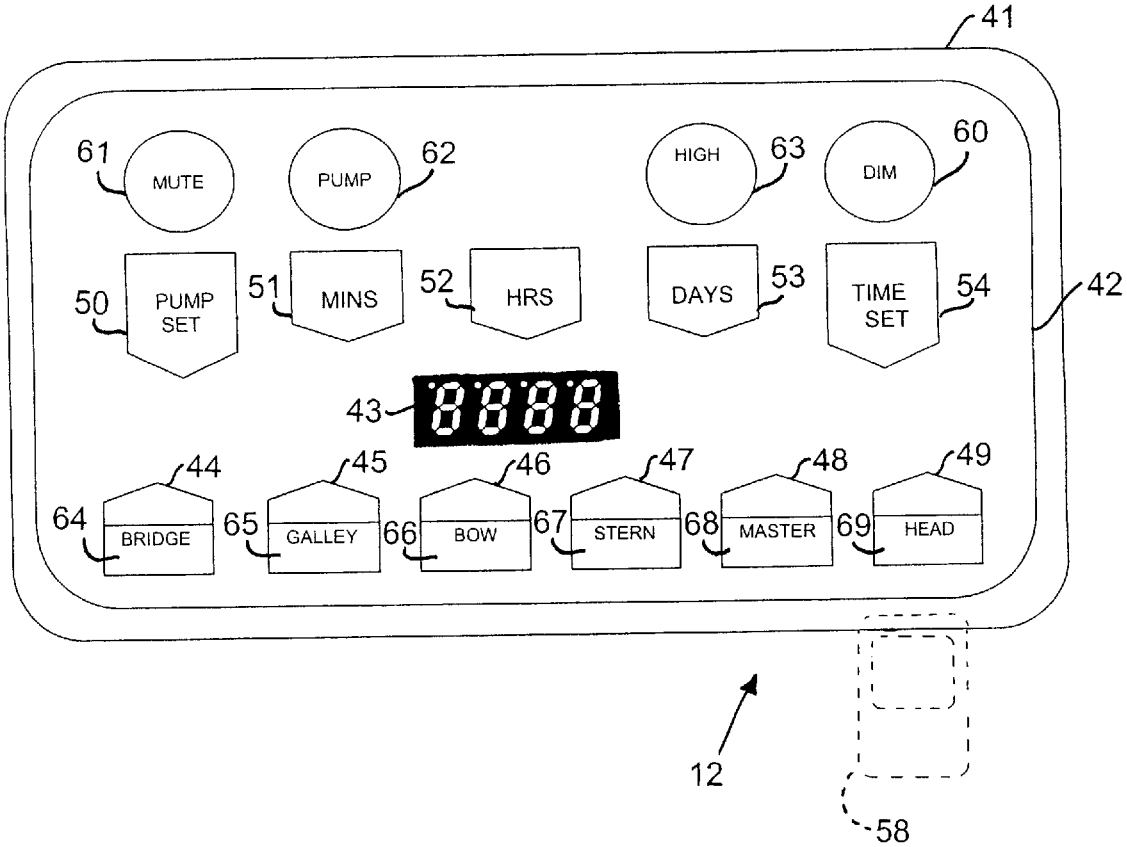
FIG. 2. sets forth a front view of the display unit control panel of the present invention bilge pump monitor and alert system.

Display unit 12 is set forth below in FIG. 4B in greater detail. However, suffice it to note here, that display unit 12 includes a display board 31 supporting a membrane switch panel 30 and a light emitting diode numeric display 32. The arrangement. of the elements within display unit 12 is shown in FIG. 2. Display board 31 of display unit 12 is operatively coupled to an interface 23 of control unit 11 by a plurality of cables or connecting wires. Display unit interface 23 is, in turn, coupled to control board 20 of control unit 11. Display unit interface 23 operates to properly condition and format information signals to be communicated between control board 20 of control unit 11 and display board 31 of display unit 12.

In the preferred embodiment of the present invention set forth below in FIGS 4A and 4B, display unit interface 23 includes a digital communication link utilizing a conventional RS232 communication format. The use of digital communication link between control unit 11 and display unit 12 reduces the number of connecting wires which must be routed between the bilge area and the pilot house location of display unit 12. Alternatively, the alternate embodiment of the present invention set forth below in FIGS. 5A and 5B, avoids the use of an RS232 communication link. Instead, a substantial plurality of connecting wires and multi-conductor cables are directly coupled between control board 20 of control unit 11 and display board 31 of display unit 12. This alternative system may be sufficient in boats which accommodate routing such a large number of wires and cables.

A plurality of pump power input sensors 14, fabricated in accordance with conventional fabrication techniques, are operative in associating with each bilge pump to provide output signals whenever the respective bilge pumps are operative. The fabrication of pump power inputs 14 are well known in the art and may be entirely conventional. The essential operating characteristic of pump sensors 14 is the provision of output signals during the operation of their respective bilge pumps. Similarly, high water switches 15 may be entirely conventional in fabrication operate to provide the essential characteristic of producing output signals whenever the water level within a given bilge compartment of the host vessel exceeds a preset maximum water level. Power supply 13 utilizes a conventional battery or plurality of batteries and may be fabricated entirely in accordance with conventional fabrication techniques.

In operation, and by means set forth below in greater detail, the user optionally establishes the desired alarm conditions for the present invention bilge pump monitor by manipulating the plurality of membrane switches supported upon membrane panel 30. The present invention defaults to a monitor system without alarms if the user does not enter pump count or pump activation time trigger levels. This operation is set forth below in greater detail. However, in accordance with an important aspect of the present invention, it will be noted that the user is able to establish individual operating parameters for each of the bilge pumps within each of the bilge compartments of the vessel. Thus, the operator is able to individually set the alarm triggering levels for the number of pump cycles also referred to as pump counts and the bilge pump activation time for each bilge pump. In addition, each high water switch within each bilge is positioned to establish a maximum water level within each of the bilge compartments.

Once the preset alarm triggering limits of the present invention bilge pump monitor have been established in accordance with the procedure set forth below, the system is ready for operation. As water accumulates within the bilge compartments, the bilge pumps perform their normal pumping actions. In the event any bilge pump within the vessel operates for a number of pump cycles which exceeds the maximum preset cycle number established by the user, control board 20 activates accessory interface 22 causing one or more of the alarm devices to be activated. Similarly, in the event any bilge pump operates for a cycle duration time exceeding the maximum preset time, accessory interface 22 is activated to operate one or more of the alarm devices coupled thereto. Finally, the activation of any of high water switches 15 due to excessive water level within any bilge compartment produces an alarm condition causing accessory interface 22 to activate one or more of the alarm devices. In accordance with a further advantage of the present invention and in the manner set forth below in greater detail, bilge pump monitor 10 also maintains important information history relating to the operation of the vessel's bilge pumps and high water switches and, more importantly, makes this information available to the operator. This information is available even if pump count and pump time alarm trigger levels have not been set. Thus, by means set forth below in greater detail, bilge pump monitor 10 operates to simultaneously monitor alarm conditions and to provide stored data which the user may access and display upon display LEDs 32 within numeric display 43 (seen in FIG. 2). This information includes the number of times each bilge pump has been activated since the last interrogation by the user. In addition, the system maintains the elapsed time period in minutes, hours and days since the first operation, if any, for each bilge pump within the boat. In further accordance with the present invention, the system identifies each bilge, if any, which has exceeded an alarm limit by flashing the associated bilge pump identifier (bilge pump buttons 44 through 49 seen in FIG. 2). A pump that has activated one or more times but has not exceeded the alarm trigger levels will be indicated by it's bilge pump identifier illuminated.

In addition, the activation of a second pump while another pump is active or the operation is examining a pump history or setting a pump condition, the second pump's indicator is blinked and the data of the second operating pump is recorded.

FIG. 2 sets forth the display panel of display unit 12 of the present invention bilge pump monitor generally referenced by numeral 40. Display panel 40 is supported within a housing 41 of display unit 12 (seen in FIG. 1). Display panel 40 is preferably fabricated utilizing a membrane switch panel 42 constructed in accordance with conventional fabrication techniques to provide a plurality of membrane switches each having visible identification indicia and each having a backlight mechanism allowing individual illumination of each membrane switch. Thus, membrane panel 42 includes a plurality of bilge pump buttons 44, 45, 46, 47, 48 and 49. Each of bilge pump buttons 44 through 49 includes a numeric indicator as well as a location indicator to uniquely identify each bilge pump button with a corresponding bilge pump located within the host vessel. The locations indicator are removable to allow each boat installation to be in essence "customized" to the host vessel and boat owner preferences. In the preferred embodiment of the present invention, each indicator is formed on a slide-in preprinted tab as shown by tab 58. It will be noted that bilge pump buttons 44 through 49 correspond to bilge pump power inputs 14 shown in FIG. 1. It will be understood by those skilled in the art, that while the embodiment of the present invention set forth herein utilizes a total of six bilge pump power inputs and bilge pump buttons, a different number of individual bilge pumps and bilge pump buttons may be utilized without departing from the spirit and scope of the present invention.

In the preferred fabrication of the present invention, the above-mentioned customizing of display panel 40 is facilitated by the structure of bilge pump buttons 44 through 49 and membrane switch panel 42 which cooperate to facilitate the attachment of location identifying indicia tabs such as tab 58 above for each bilge pump button. In this manner, the user is able to custom design display panel 40 to the particular arrangement of. bilge pumps within the host vessel. In the example shown in FIG. 2, bilge pump button 44 indicates the bilge pump located in the bridge area while bilge pump button 45 indicates the bilge pump located in the galley and bilge pump 46 indicates the bilge pump located in the bow. Similarly, buttons 47, 48 and 49 indicate the bilge pumps located in the stern, master state room and head bilge compartments respectively.

In the fabrication of membrane switch panel 42 set forth in FIG. 2, bilge pump buttons 44 through 49 include light transmissive illumination portions 64 through 69. Thus, each of buttons 44 through 49 may be independently illuminated by energizing the corresponding illumination device (not shown) associated with each of buttons. This illumination is carried forward utilizing a conventional "backlight" membrane switch panel in the fabrication of membrane panel 42. However, it will be apparent to those skilled in the art that other illumination devices may be used without departing from the spirit and scope of the present invention. Similarly, display panel 40 utilizes a four digit numeric display for numeric display 43 which, the preferred fabrication of display panel 40 comprises four conventional light emitting diode (LED) seven segment numeric display digits. However, other numeric displays may be used without departing from the invention.

Display panel 40 further includes a pump set button 50, a time set button 54, a dimmer button 60 and a mute button 61. In addition, display panel 40 further includes a minute button 51, an hour button 52 and a day button 53. Finally, display panel 40 includes a pump indicator element 62 and a high water indicator element 63. Buttons 50 through 54 and buttons 60 and 61 include light transmissive indicia which are illuminatible by the backlight illumination apparatus of membrane panel 42 and which typically comprise letters indicative of each bilge pump. Pump indicator 62 and high water indicator 63 are preferably formed of a color tinted light transmissive material such that illumination of the associated illumination elements of indicators 62 or 63 causes a corresponding illumination of the entire indicator.

In operation, and in accordance with an important aspect of the present invention described below in greater detail, the user is able, through manipulation of display panel 40, to custom program the operating alarm parameters of each independent bilge pump monitoring activity of the system. Thus, for example, the user is able to establish the number of on/off cycles which determines the alarm threshold for each individual bilge pump. The setting of maximum pump cycles for each bilge is carried forward by initially depressing pump set button 50 and thereafter pressing a selected one of bilge pump buttons 44 through 49. The illumination element of the selected bilge pump button is then activated. Present value of the pump count trigger level is displayed in LED numeric display. The user presses pump set button 50 and holds the pump set button observing the counts number on numeric display 43. The initial press and hold of pump set button 50 increases the count set number. The count set number may be changed from increasing to decreasing by simply pressing pump set button 50 a second time and holding it until the desired limit number is displayed by numeric display 43. This process may be repeated for each of bilge pump buttons 44 through 49 to establish individual maximum numbers of on/off cycles for each bilge pump. The value of zero disables the pump count alarm for that particular bilge. Once the individual maximum cycle numbers for each of the bilge pumps have been established, the system will trigger an alarm whenever any bilge pump operates for a cycle number greater than or equal to the maximum established number for the pump.

In a similar manner and in further accordance with an important aspect of the present invention, the user is able to further program the system to establish a maximum time of cycle time operation for which any bilge pump is allowed to operate before triggering an alarm condition. The setting of maximum cycle duration for each bilge pump, which is independent of the cycle count number, is user programmable by initially pressing time set button 54 and thereafter pressing the selected one of bilge pump buttons 44 through 49. The selected bilge pump button then lights. The present value of the pump time trigger level is displayed in the LED numeric display 43. The user then presses time set button 54 and holds the button depressed while viewing the value displayed on display 43. Once again, the direction of change of the set time duration is alternately increased or decreased as time set button 54 is pressed and held. Thus, pressing and holding time set button 54 initially will increase the time duration setting while pressing and holding time set button 54 a second time will begin decreasing the time duration setting. This process may be repeated for each of bilge pump buttons 44 through 49 to program the maximum cycle duration for each bilge pump within the system. Once the time duration limits have been programmed for each bilge pump, the system will trigger an alarm condition each time a bilge pump operates for a cycle time exceeding the established time duration limit. A value of zero disables the pump time alarm for that particular bilge.

Once the user has programmed the system to provide maximum cycle numbers and cycle time duration limits for each bilge pump, the system is configured for alarm operation. In the typical environment in which the present invention system operates, one or more of the bilge pumps within the boat will operate from time to time. This reflects normal conditions of operation for most boats in that the various bilge compartments within the boat can accumulate some water during boat operation or periods of non-use. The extent of water accumulation within the various bilge compartments of a boat is usually different from other bilge compartments. Thus, in accordance with an important aspect of the present invention, the ability of the system to facilitate independent programming of the alarm conditions for each bilge pump allows the boat owner to accommodate the different water accumulation characteristics of different bilge compartments. For example, the bilge compartment within which the engine or engines are located typically accumulates a substantially greater amount of water than the bilge compartment in the bow of the boat. In the present invention system, the user is able to program the maximum bilge pump cycle time and maximum number of bilge pump on/off cycles for the engine bilge at different alarm conditions than the bow bilge and so on. Typically, the stuffing boxes for the propeller shaft causes a continuous accumulation of bilge water. This is an example of the need for different alarm settings in different bilge compartments.

Thus, whether the boat is at rest or in operation, the present invention bilge pump monitor system operates to provide three basic types of bilge pump monitoring. The first type of nitoring involves the indication of bilge pump operation upon display panel 40 each time a bilge pump initiates operation. When a pump begins operating, the associated bilge pump button is illuminated and an audible beep or tone is produced. The second monitoring function occurs as the pump operates and numeric display 43 is configured to display the number corresponding to the total number or pump on/off cycles which the present invention pump actuation represents. In this function, the termination of bilge pump operation results in terminating the flashing of the bilge pump button and audible beep as well as the numeric display on display 43. The third type of bilge pump monitoring is operated continuously as the history of bilge pump operation for each bilge pump is maintained and stored. The stored data is continuously compared to the maximum limits for number of cycles and cycle time duration for each and an alarm is triggered when a limit is equaled or exceeded if the particular limit is greater than zero.

When a pump alarm is activated, the red "PUMP" warning light (indicator 62 of display panel 40) is illuminated and caused to flash while the audible alarm is operative. The alarm will continue to operate until the problem is corrected. In the meantime, the user is able to mute the audible alarm for a period of time by pressing mute button 61 on display panel 40. However, if the problem is not corrected within a predetermined time limit, the audible alarm will resume active operation. Correspondingly, the bilge light button associated with a bilge compartment in which the problem exists will flash directing the operator to the problem bilge.

In accordance with an important aspect of the present invention, this stored data is maintained to provide a history of past operation available to the boat operator for system analysis. This stored data will be maintained in nonvolatile memory even if input power to the bilge pump monitor system is removed. The user can retriever this data when input power is restored.

During the normal operation of the present invention bilge pump monitor and alert system, the operation of any bilge pump causes the associated bilge pump button to flash. The bilge pump button flashing is accompanied by an audible beep and the display upon numeric display 43 of the number of pump operations which the current activation represents. In the normal coarse of pump operation, the bilge pump accomplishes its task and automatically shuts off. Following pump shut off, numeric display 43 is turned off and the new pump count is stored within the system memory. The bilge pump button remains illuminated. The user may depress the pump button to recall the history of pump activation's. In addition, the user may depress and hold the bilge pump button to erase the stored history and reset the pump cycle count. The bilge pump button for that particular pump will not longer be illuminated.

As mentioned above, each of the bilge areas of the vessel includes a high water float switch which is conventional in fabrication and which functions to activate whenever the water level within the associated bilge compartment rises to a predetermined maximum tolerable level. Such high water switches are well known in the art, and typically operate in response to an excessive water level to trigger a warning alarm and/or light device. In the present system, the activation of a high water switch is interpreted as an indication of a problem which the bilge pump is unable to handle raising the possibility of the area becoming flooded. In response, the present system activates the alarm apparatus operative under the control of interface 22 (seen in FIG. 1). When this high water alarm is activated, the red "HIGH WATER" warning light (indicator 63 of display panel 40) is illuminated and caused to flash while the audible alarms are operative. The alarm will continue to operate until the problem is corrected. In the meantime, the user is able to mute the audible alarm for a period of time by pressing mute button 61 on display panel 40. However, if the problem is not corrected within a predetermined time limit, the audible alarm will resume active operation. Correspondingly, the bilge light button associated with the bilge compartment in which the high water switch activated will flash directing the operator to the specific bilge compartment area having the alarm condition. If during the alarm sequence, the water level within the bilge compartments triggering the alarm is reduced by the bilge pump or other apparatus, the system will. terminate the high water alarm automatically as the water level subsides.

In accordance with a further advantage of the present invention bilge pump monitor, the system maintains the data indicating the elapsed time since the first pump activation in each of the six bilge compartments. The user depresses the illuminated corresponding bilge pump button followed by pressing any one of buttons 51, 52,and 53 which correspond to "MINUTES, HOURS, DAYS". The requested information is then displayed by numeric display 43.

The illumination level of display panel 40 may be adjusted by pressing dimmer button 60 of display panel 40. The user simply presses and holds dimmer button 60 until the desired illumination level is presented by display panel 40. When dimmer button 60 is initially pressed and held, the illumination level of display panel 40 is increased and continues to be increased as the user holds button 60. Illumination level may be decreased by pressing dimmer button 60 a second time and holding it as the illumination level is decreased until the desired illumination is presented.

Figure 3:
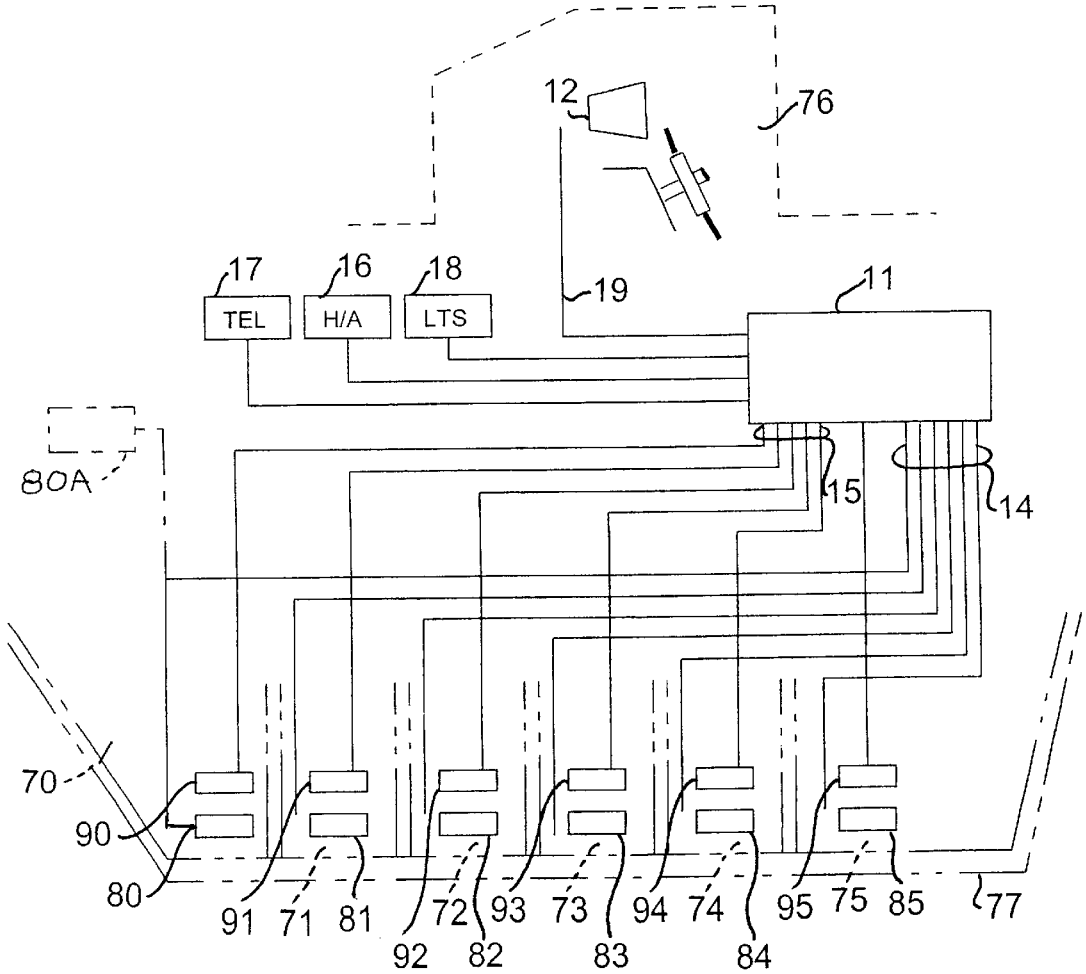
FIG. 3 sets forth a block diagram of the present invention bilge pump monitor and alert system in a typical installation.

FIG. 3 sets forth a further block diagram of the present invention bilge pump monitor and alert system together with a dashed-line depiction of a hull and pilot house of a host vessel. It will be recognized that hull 77 and pilot house 76 of the host vessel are provided merely for illustration and are not to be interpreted as an actual vessel. Thus for purposes of illustration, hull 77 is shown having a plurality of bilge compartments 70 through 75 formed along the lower portion of hull 77 and separated by intervening partitions. Similarly, pilot house 76 is shown having a general representation of the operator station of a typical vessel. It will be recognized that in a practical operating vessel, the space between hull 77 and pilot house 76 may, depending upon vessel size, be separated by several levels or decks with intervening state rooms, galley, heads and so on.

A control unit 11 includes a plurality of bilge pump inputs 14 and a plurality of high water switch inputs 15. The system further includes a plurality of bilge pumps 80 through 85 situated within bilge compartments 70 through 75 respectively. Bilge pumps 80 through 85 may be fabricated entirely in accordance with conventional fabrication techniques and will be understood to include operative coupling to a battery power source (not shown). In addition, bilge pumps 80 through 85 are selected from the fabrication type which includes an output connection for communicating the occurrence of bilge pump operation. Accordingly, bilge pumps 80 through 85 are coupled to bilge input power inputs 14 of control unit 11.

In further accordance with conventional fabrication techniques, bilge compartments 70 through 75 further support respective high water alarm switches 90 through 95. Switches 90 through 95 function in accordance with conventional fabrication techniques and provide an output alarm signal when, and if, the water level within their host compartment exceeds a predetermined level. A typical fabrication of such high water switches includes a simple flotation switch having a movable float which is moved as the water level rises. High water switches 90 through 95 are operatively coupled to control unit 11 to form high water switch inputs 15.

In further accordance with the present invention, control unit 11 is coupled to a plurality of alarm devices. For purposes of illustration, these alarm devices include a telephone auto dialer 17, a horn or other audible alarm unit 16 and a strobe light unit 18. The fabrication of telephone unit 17, audible alarm 16 and light unit 18 may be constructed entirely in accordance with conventional fabrication techniques. A display unit 12 fabricated in accordance with the present invention, is supported within pilot house 76 so-as-to-be visible to the vessel operator and to be operable by the vessel operator. A communication link 19 operatively couples display unit 12 to control unit 11.

Communication link 19 is of particular importance with respect to the present invention, in that it forms a basic consideration in selecting between the illustrative embodiments of the present invention set forth below in greater detail. In most vessel structures, the locations of control unit 11 and display unit 12 within the vessel make the routing of communication link 19 somewhat difficult due to multiple decks and partitions to be transversed. Accordingly, the preferred fabrication of the present invention in such circumstances utilizes the dual processor embodiment in which control unit 11 and display unit 12 maintain independent microprocessors in the manner shown in FIGS. 4A and 4B below. The use of independent microprocessors in display unit 12 and control unit 11 allows communication link 19 to be provided by a relatively few number of connecting wires and cables. Conversely, in the event the host vessel is able to accommodate a substantially increased number of connecting wires within communication link 19 due to the location of control unit 11 and display unit 12 and the number of intervening deck levels and compartments, the alternate embodiment of the present invention set forth below in FIGS. 5A and 5B may be used. In such case, communication link 19 includes a substantially increased plurality of connecting wires but enjoys the advantage of not requiring a second microprocessor within display unit 12. This difference in communication link 19 and the supporting circuitry in display unit 12 and control unit 11 forms the basic difference between the embodiments of the present invention shown in FIGS. 4A and 4B and the alternate embodiment shown in FIGS. 5A and 5B.

FIG. 3 also sets forth a further variation of the present invention pump monitor system. In many boats, the number of bilge compartments may be fewer than the six compartments shown for hull 77. In such case, the unused bilge monitor or monitors may be used to monitor one or more non-bilge pumps operative on the boat. In most boats additional pumps are operative for functions such as fresh water pumps, bait tank pumps hydraulic system pumps. Monitoring such non-bilge pumps in a similar manner and setting alarm conditions is extremely advantageous for the boat operator. For example, if a guest on a boat unintentionally fails to fully close a fresh water faucet in one of the heads, or elsewhere, the pump maximum cycle duration feature of the present invention monitor system would trigger an alerting alarm. This would prevent excessive loss of important fresh water. In a similar manner, the monitoring of other non-bilge. pumps is desirable.

For purposes of illustration, FIG. 3 shows a non-bilge pump 80A in dash-line. In this example, pump 80 is not required if, for example, bilge compartments 70 and 71 are combined giving hull 77 five bilge compartments. Since only five bilge's of hull 77 are fabricated -in this example, pump 80A may be monitored. Non-bilge pump 80A is then monitored and set with alarm conditions in the same manner as the system bilge pumps.

Figure 4A:
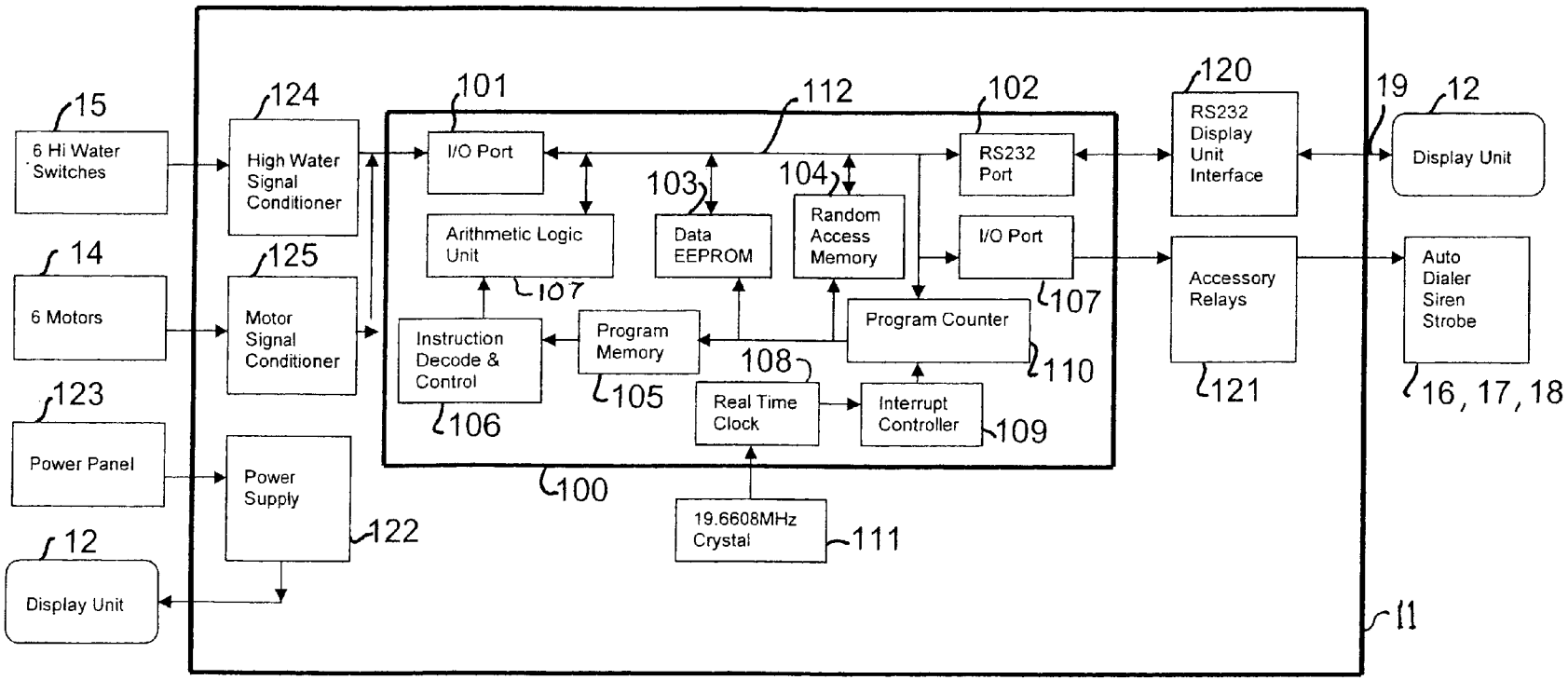
FIGS. 4A and 4B taken together set forth a detailed block diagram of the present invention bilge pump monitor and alert system.
Figure 4B:
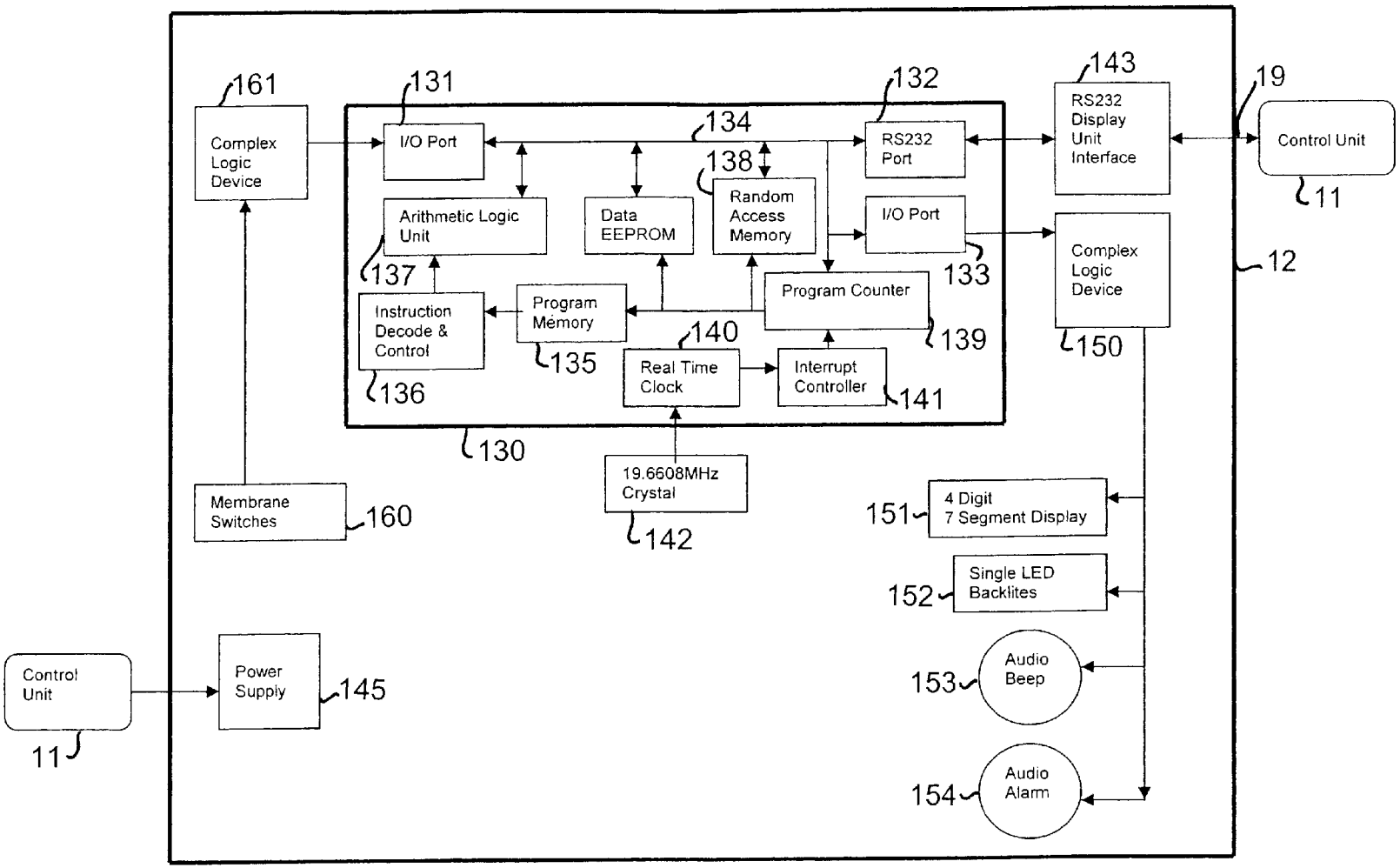

FIGS. 4A and 4B taken together, set forth block diagram representation of the present invention bilge pump monitor and alert system. As described above, the control unit shown in FIG. 4A and the display unit shown in FIG. 4B are operatively coupled by a communication link 19 (seen in FIG. 3).

More specifically, control unit 11 includes a microprocessor 100 fabricated in accordance with conventional fabrication techniques. Accordingly, microprocessor 100 includes an input/output port 101 and an RS232 port 102. Microprocessor 100 further includes an input/output port 107. A real time clock 108 is controlled by a reference crystal 111 in accordance with conventional fabrication techniques. Clock 108 is coupled to an interrupt control 109 which in turn is coupled to a program controller 110. Program counter 110 is operatively coupled to a program memory 105 by an address bus which in turn is coupled to an instruction decode and control portion 106. An arithmetic logic unit 107 is coupled to instruction decode and control unit 106 and is further coupled to a data bus 112. In further accordance with conventional fabrication techniques, data bus 112 is operatively coupled between input/output ports 101 and 107 as well as RS232 port 102. Data bus 112 functions to provide data transfer within microprocessor 100. Accordingly, arithmetic logic unit 107 together with random access memory 104 and electrically erasable programmable read only memory (EEPROM) 103 are operatively coupled to data bus 112. The EEPROM 103 is nonvolatile memory and is used to store all history data, alarm trigger levels and dimmer settings. This data will not be lost if input power to the bilge pump monitor is removed.

An RS232 interface is operatively coupled between port 102 and display unit 12. Display unit 12 will be recalled, is coupled to interface 120 by a communication link 19. Control unit 11 further includes a plurality of accessory relays operated in response to signals provided from input/output port 107. Relays 121 respond to output data signals of processor 100 to operate alarm units 16, 17 and 18.

A plurality of high water switches 15 are coupled to input/output port 101 by a high water signal conditioning circuit 124. Similarly, a plurality of bilge pump motors 14 are coupled to input/output port 101 by a motor signal conditioning circuit 125. A power supply 122 is coupled to control unit 12 to provide operative power and is further coupled to the vessel power panel 123.

In operation, processor 100 operates under the control of a stored instruction set or program within program memory 105 to provide the control unit operation of the present invention bilge pump monitor and alert system. This operation includes. response to high water switches 15 and bilge pump motors 14 to provide the above described programmable operation. The stored instruction set which controls processor 100 is set forth below in the flow diagrams of FIGS. 6 through 27. Suffice it to note here, that microprocessor 100 receives input signal information from high water switches 15 and bilge pump motors 14 and operates in the manner described above to control the operation of display unit 12 and alarm devices 16, 17 and 18. In addition, microprocessor 100 maintains a stored data history within random access memory 104 and EEPROM 103 which facilitates the user ability to access the above described pump operational history. In addition, the stored instruction set within the program memory 105 operates in the manner set forth below to facilitate the above described programmable functions of the present invention by which the user is able to set the alarm limits for pump count cycles and pump duration described above.

FIG. 4B sets forth a block diagram of display unit 12 which operates in combination with control unit 11 shown in block diagram form in FIG. 4A. The embodiment of the present invention shown in FIG. 4B corresponds to the dual microprocessor embodiment of the present invention mentioned above which utilizes an RS232 communication link.

More specifically, display unit 12 includes a microprocessor 130 fabricated in accordance with conventional fabrication techniques. Microprocessor 130 is substantially identical to microprocessor 100 of control unit 11 (seen in FIG. 4A). Thus, microprocessor 130 includes an input/output port 131, an RS232 port 132, and an input/output port 133 all coupled to a data bus 134. Microprocessor 130 further includes an EEPROM 134 and program memory 135. An instruction decode and control unit 136 is coupled to program memory 135 and is further coupled to an arithmetic logic unit 137. Arithmetic unit 137 is coupled to data bus 134. Microprocessor 130 further includes a random access memory 138 coupled to data bus 134.

A real time clock 140 is coupled to a reference crystal 142 and is further coupled to an interrupt controller 141. Interrupt controller 141 is coupled to a program counter 139. An address bus is coupled between program counter 139 and random access 138, processor unit 134, and program memory 135.

RS232 port 132 is coupled to a display unit interface 143 which in turn is coupled to control unit 11 by a communication link 19. Input/output port 133 is coupled to a complex logic device 150. Complex logic device 150 provide operative control of numeric display 151 as well as a plurality of light emitting diode backlights 152. An audio alarm 154 and an audio beep tone circuit 153 are also coupled to complex logic device 150.

A plurality of membrane switches 160 are coupled to a complex logic device 161 which in turn is coupled to input/output 131. Membrane switches 160 are fabricated in accordance with conventional fabrication techniques and includes a matrix of membrane switches which are arranged in accordance with display panel 40 shown in FIG. 2. A power supply 145 receives power from control unit 11 and provides operative power for control unit 12.

In operation, membrane switches 160 are manipulated by the user to apply input signals to complex logic device 161. Complex logic device 161 converts the matrix input signals from switches 160 to appropriately formatted digital data which is applied to input/output port 131 of microprocessor 130. Microprocessor 130 operates under the control of a stored instruction set within program memory 135. The overall function of microprocessor 130 is to respond to the users input information provided by membrane switches 160 to communicate the corresponding system programming represented thereby to control unit 11 utilizing the RS232 communication format provided by port 132 and interface 143. This information is utilized by control unit 11 in the manner described below to establish the desired operational parameters of the present invention system such as the alarm triggering levels for pump cycle count and pump cycle duration. In addition, the manipulation of membrane switches by the user also facilitates the user access to the stored history within control unit 11. In such case, the input signals provided by the users manipulation of switches 160 is communicated by microprocessor 130 to control unit 11 to elicit the required data and the transfer of the history data upwardly to display unit 12. Thereafter, processor 130 configures the uplinked data to the appropriate format for application to complex logic device 150 via input/output port 133. Thereafter, complex logic device 150 configures the numeric display of display 151 to provide the desired history data. Complex device logic 150 also controls the illumination of the operated switches within membrane switches. 160 to provide backlighting illumination thereof. Finally, audio beep tone circuit 153 and audio alarm 154 are controlled by logic device 150 in response to data communicated upwardly through communication link 119 from control unit 11.

Figure 5A:
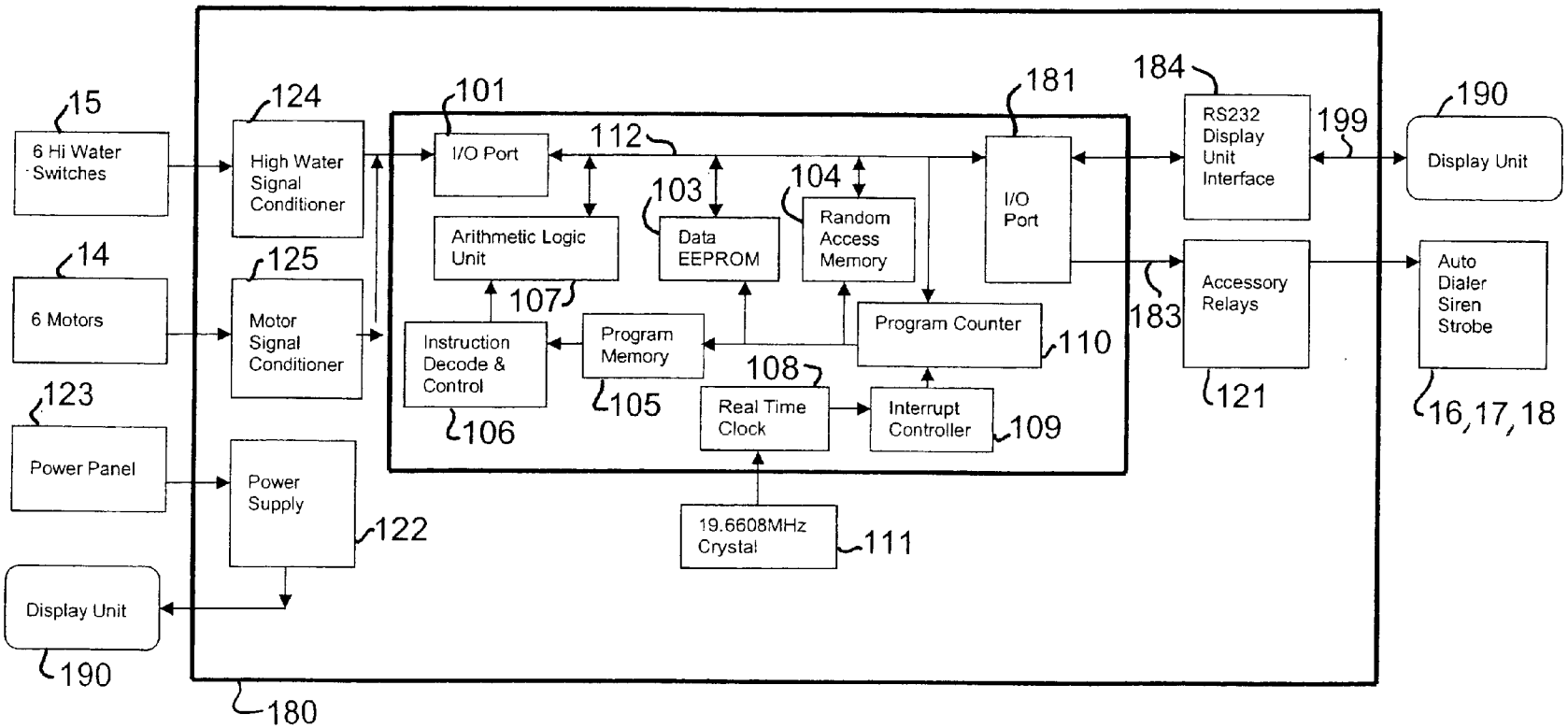
FIGS. 5A and 5B taken together set forth a detailed block diagram of an alternate embodiment of the present invention bilge pump monitor and alert system.
Figure 5B:
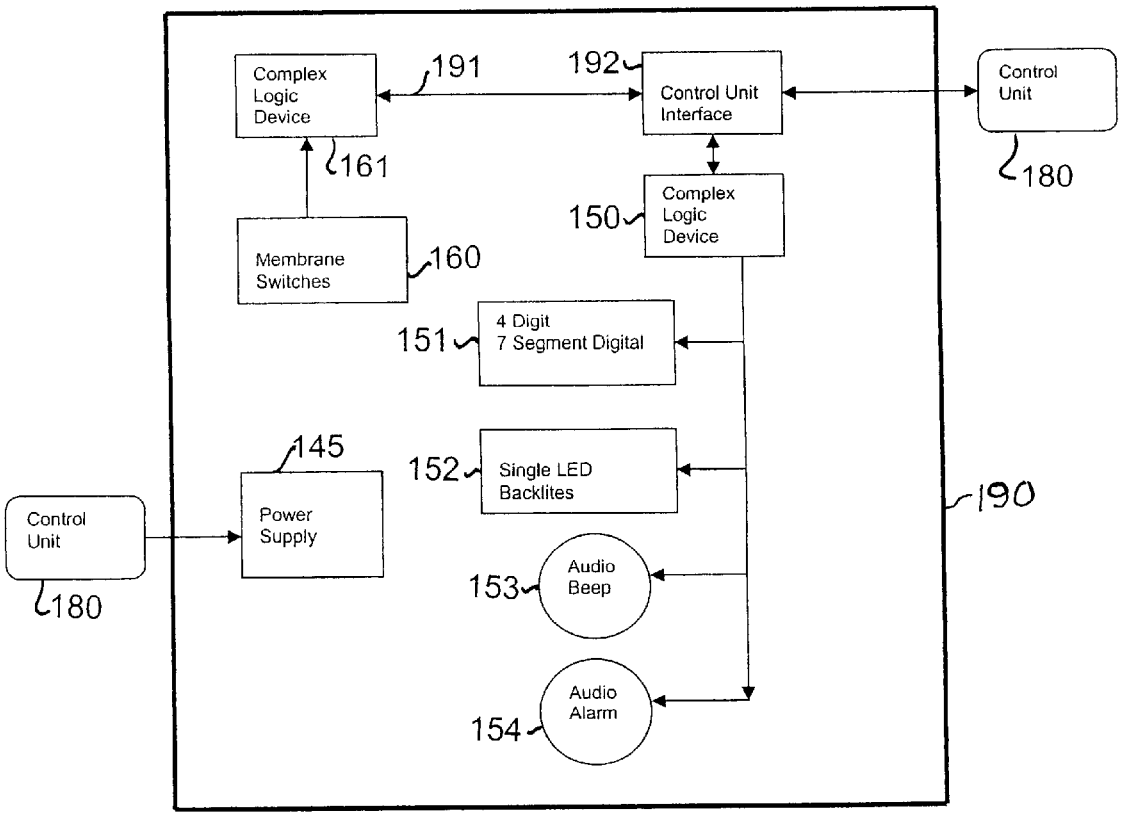

FIG. 5A and 5B taken together, provide block diagram representation of an alternate embodiment of the present invention bilge pump monitor and alert system. By way of overview, it will be noted that the control unit of the alternate embodiment shown in FIG. 5A corresponds almost entirely to control unit 11 shown in FIG. 4A. As mentioned above, the only difference between the embodiment shown in FIGS. 4A and 4B and the alternate embodiment shown in FIGS. 5A and 5B is found in the manner in which data is communicated between the control unit and the display unit. Control unit 11 and display unit 12 shown in FIGS. 4A and 4B, utilize an RS232 communication protocol having interface 120 and communication link 19. In order to manage the operation of RS232 communication, display unit 12 utilizes a microprocessor 130 and an RS232 interface 143. In contrast, the embodiment shown in FIGS. 5A and 5B utilizes a conventional interface and communication link 199 which is not an RS232 data link. Accordingly, the need for a microprocessor within display unit 190. of the alternate embodiment shown in FIGS. 5A and 5B is thus avoided and the display unit is substantially simplified.

More specifically, FIG. 5A sets forth a block diagram of control unit 180. Control unit 180 is, as mentioned above, substantially similar to control unit 11 described above. Thus, control unit 180 includes a microprocessor 100 having an input/output port 101 and a data bus 112. Microprocessor 100 includes an EEPROM 103 coupled to data bus 112 and an associated program memory 105. EEPROM 103 is non-volatile memory and is used to store all history data, alarm trigger levels and dimmer setting. This data will not be lost if input power to the bilge pump monitor is removed. Memory 105 stores a program instruction set and is operatively coupled to an instruction and decoded control 106. An arithmetic logic unit is coupled to control 106 and data bus 112. Microprocessor 100 further includes a real time clock 108 having a reference crystal 111 and coupled to an interrupt controller 109. A program counter 110 is coupled to interrupt controller 109 and data bus 112. A random access memory 104 is coupled to data bus 112 and program counter 110 as well as program memory 105. Control unit 180 further includes a high water signal conditioner 124 coupled to input/output port 101 and is further coupled to a plurality of high water switches 115. A motor signal conditioner 125 is coupled to input/output port 101 and a plurality of bilge pump motors 14. A power supply 122 is coupled to display unit 190 and is further coupled to a power panel 123.

The structure of control unit 180 thus far described, is substantially identical to control unit 11 shown in FIG. 4A. Control unit 180 utilizes an input/output port 181 coupled to data bus 112 having an communication link 183 coupled to a plurality of accessory relays 121. Relays 121 are coupled to alarm devices 16, 17 and 18. Input/output port 181 is further coupled to a display unit interface 184 via a communication link 182. Display unit interface 184 is conventional and does not include the above described RS232 interface. Interface 184 is coupled to display unit 190 by a plurality of direct connecting wires 199.

The operation of control unit 180 is substantially identical to the operation of control unit 11. Thus, the descriptions set forth above in conjunction with control unit 11 should be understood to apply equally well to control unit 180 with the exception of direct communication via connecting wires 199 in place of the above described RS232 communication.

FIG. 5B sets forth a block diagram of display unit 190 which is operative in combination with control unit 180 shown in FIG. 5A. As mentioned above, display unit 190 utilizes a direct multi-wire coupling 199 to interface with control unit 180. As is also described above, this avoids the need for a microprocessor within display unit 190. The remainder of display unit 190 apart from microprocessor 130 and RS232 control unit interface 143, is substantially identical to display unit 12 described above in FIG. 4B. Thus, display unit 190 includes a complex logic device 161 coupled to a plurality of membrane switches 160. Membrane switches 160 are arranged in the same manner as described above and as is shown in FIG. 2. A control unit interface 192 is coupled to complex logic device 161 by a data bus 191. Interface 192 is further coupled to control unit 180 by a plurality of connecting wires 199. A complex logic device 150 is coupled to control unit interface 192 and is further coupled to numeric display 151, backlights 152, audio beep tone circuit 153 and audio alarm 154. The operation of complex logic device 150 and display 151 as well as backlights 152 and audio beep 153 and audio alarm 154 is substantially identical to the above described operation set forth in display unit 12 in FIG. 4B.

In the operation of display unit 190, the processor within control unit 180 is operative to control the processor functions needed for operation of display unit 190. Thus, display unit 190 receives all data commands from control unit 180 via couplings 199. Interface 192 simply applies the communicated commands to complex logic device 150 and/or complex logic device 161. Thus, in essence, display unit 190 is operated fully in response to control unit 180. Similarly, inputs from the user applied to membrane switches 160 are not processed by display unit 190 but rather are communicated to control unit 180 which in turn responds after processing and applies appropriate data signals to control the numeric display, backlights, audio tone and audio alarm.

Figure 6:
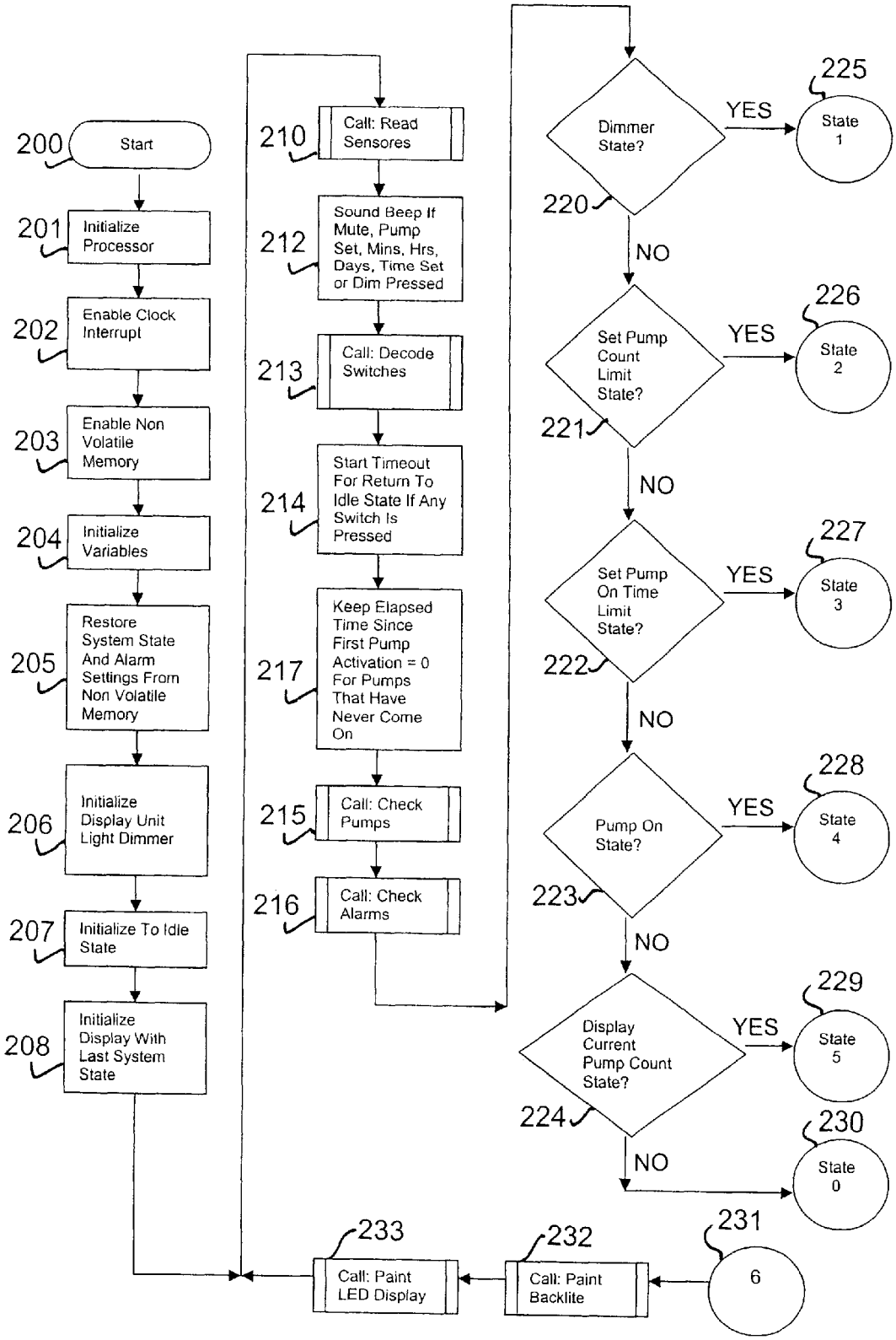
FIG. 6 sets forth a flow diagram of the control unit main loop portion of the embodiment of the present invention bilge pump monitor and alert system set forth in FIG. 4A.

FIG. 6 sets forth a flow diagram of the control unit of the present invention bilge pump monitor and alert system. By way of overview, the main program loop is operated through a plurality of initializing steps after which the system continuously operates through the main program loop with temporary branching to other program functions and returns to the main program loop. Thus, each time the user inputs data or attempts to read data from the system, the branching required to perform the desired function is implemented the next time that the system moves through that portion of the main program loop. Similarly, different program calls are placed within the sequence of main program loop operation which also perform branching functions taking the system operation from the main loop to perform the called function after which the system returns to the main loop. Most of these call functions operate without user input.

More specifically, the main program loop begins at an initial step 200 which generally corresponds to the initial activation or power up of the system. At step 201, the processor is initialized after which at step 202 the clock interrupt is enabled. At step 203, the non-volatile memory (EEPROM) is enabled to facilitate reading and writing data to or from the memory. At step 204, the system variables are initialized which in most instances involves setting the system variables to zero. At step 205, the system state is restored and alarm settings are retrieved from the non-volatile memory. This process involves an overwrite of system information with the last history data. At step 206, the display unit light dimmer is initialized using the last memory setting. At step 207, the system is initialized to the idle state after which the initializing process is completed at step 208 with the display system last state being retrieved from memory. This completes the initializing process and allows. the system to enter the main program loop.

The main program loop begins with a call to read the system sensors at step 210. At step 212, various responsive operations are performed including sound beep if mute, pump set, minutes, hours, days, time set or dimmer pressed. At step 213, a call to decode switches is initiated and at step 214, a time out is commenced for return to idle state in the event a switch is pressed. At step 217, data such as elapsed time since first pump activation is set to zero for pumps that have never activated. At steps 215 and 216, the check pumps and check alarm sub-routines are called.

The main program loop thereafter moves through a series of inquiries in which the loop is able to branch to other routines, programs and other sub-routines. Thus, at step 220, an inquiry is made as to whether the dimmer state has been entered. If not, an inquiry is then made at step 221 as to whether the set pump count limit state has been entered. If not, at step 222 an inquiry is made as to whether the set pump on time limit state has been entered. If the state has not been entered, the system moves to an inquiry at step 223 determining whether the pump on state is to be entered. Finally, at step 224, a determination is made as to whether .the display current pump counts state has been entered. If all of steps 220 through 224 have resulted in negative responses, the system then moves to idle state 230 which is shown in FIG. 7 and described below.

In the event a positive response is found in steps 220 through 224 however, the system branches to the corresponding state or program portion. Thus, a positive response at step 220, causes the program to move to step 225 which initiates the dimmer state shown in FIG. 8. Similarly, a positive response at step 221, causes the system to move to step 226 initiating the set pump count limit state shown in FIG. 9. Correspondingly, positive responses at steps 222, 223 for 224 cause respective branching of the system operation to the set pump on time limit state at step 227, the pump on state at step 228, or the display current pump count state at step 229. Steps 227, 228 and 229 are shown as FIGS. 10, 11 and 12 below.

Following each of the above described branching of the system to any of states 225 through 230, the system completes the particular or sub-routine and thereafter moves to a return to main loop step 231. At step 231, the system moves through steps 232 and 233 in which the sub-routines for paint backlight and paint LED display are called. At the completion of step 233, the system returns to step 210 and the main loop process is repeated. Thus, the system cycles from steps 210 through 217 during each main program loop cycle and cycles through one or more inquiry steps 220 through 224 until a positive response is determined. A positive response to any of steps 220 through 224 causes the system to immediately branch to the corresponding routine or sub-routine and thereafter return to step 231 and cycle back to step 210 and initiate the next main program loop cycle. A new state at steps 220 through 224 is maintained each time through the main loop until the new state returns the program to the idle state.

Figure 7:
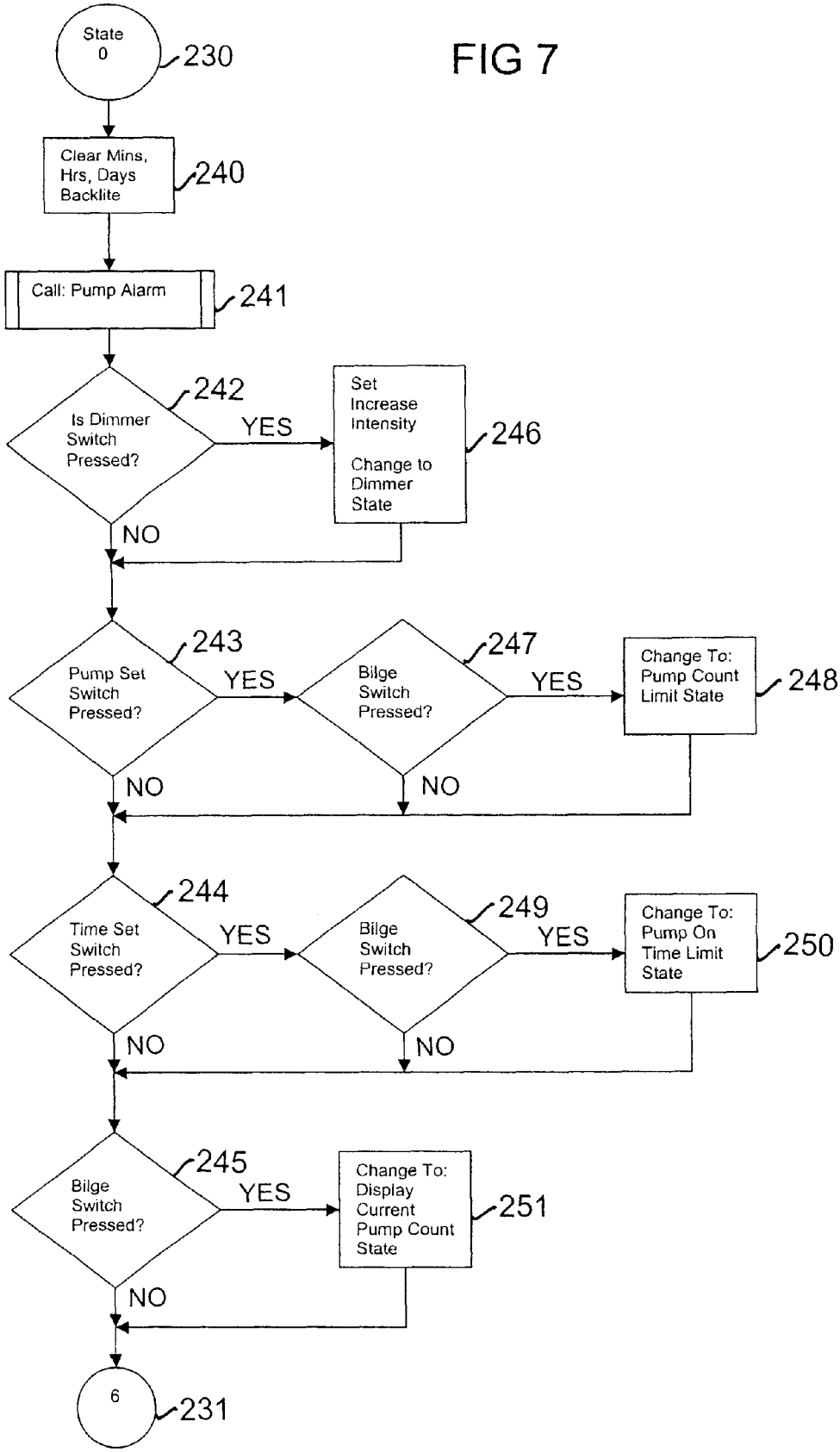
FIG. 7 sets forth a flow diagram of the control unit idle state portion of the present invention bilge pump monitor and alert system.

FIG. 7 sets forth a flow diagram of the control unit processor operation which is initiated following the inquiry at step 224 and the system movement to the idle state at step 230 (seen in FIG. 6). It will be noted, that the idle state for the system results from the absence of user inputs and sensor inputs during the processor cycle through the main program loop of FIG. 6. The overall function of the idle state is to in essence provide a polling of the various input switches operated by the user and program calls initiated by the system. Thus, the idle state is entered at step 230 after which the minutes, hours, and days backlight of the display unit is cleared at step 240 and the system calls the pump alarm sub-routine at step 241. Thereafter, an inquiry is made as to whether the dimmer switch is pressed at 242. If the dimmer switch has not been pressed, the system then determines whether the pump sets switch has been pressed at step 243. In the absence-of a detected pump set switch actuation at step 243, the system determines at step 244 whether the time switch has been pressed. If the time set switch has not been pressed, the system determines at step 245 whether the bilge switch has been pressed. If a bilge switch activation is not detected at step 245, the system returns to the main program loop at step 231. Thus, in the absence of the user having pressed one or more of the user control button on the display unit membrane switch described above, the idle state simply repeatedly cycles through a polling of the switches and returns to the main program loop. This cycling continues in the absence of switch actuation with the system moving repeatedly through the main program loop and steps 230 through 245 of the idle state program portion.

If however, a determination is made at any one of steps 242 through 245 that a switch has been actuated, the system then branches to respond to switch actuation. Thus, if a determination is made at step 242 that the dimmer switch has been pressed, the system moves through a step 246 in which the direction of illumination intensity of the backlight is set to increase. Also at step 246, the system changes to the dimmer state so that at step 220 the yes branch is taken. The dimmer state flow diagram is set forth below in FIG. 8. Suffice it to note here, that the dimmer state functions to change the illumination level of the display unit described above. In the event a pump set switch activation is detected at step 243, the system determines at step 247 whether a bilge switch has been pressed. If no bilge switch has been pressed, the system moves to the inquiry at step 244. If however a determination is made that a bilge switch has been pressed, the system moves to a step 248 in which the system sets to the pump count limit state. The system then returns to step 244. With the pump count limit state set, the system will enter the pump count limit state following step 221 (seen in FIG. 6) the next time the system cycles through the main program loop (seen in FIG. 6).

If a determination is made at step 244 that the time set switch has been pressed, the system moves to step 249 and determines whether a bilge switch is pressed. In the absence of a bilge switch being pressed by the user the system moves directly to step 245. If however a bilge switch has been pressed, the system moves to step 250 in which it sets the pump on time limit state in the main loop of FIG. 6. Thereafter, the system returns to step 245. The setting of the pump on time limit state causes the system to branch to pump on time limit state 227 from step 222 (seen in FIG. 6) the next time that the system moves through the main program loop. Finally, a determination at step 245 that a bilge switch has been pressed, causes the system to set the display current pump count state at step 251. The setting of the display current pump count state causes the system to branch to current pump counter state 229 following step 224 (seen in FIG. 6) the next time that the system moves through the main program loop. Thus, in the idle state and in the continued absence of a positive response at steps 220 through 224. The system continuously cycles through the main program loop and steps 242 through 245 until a user operated input switch is activated.

Figure 8:
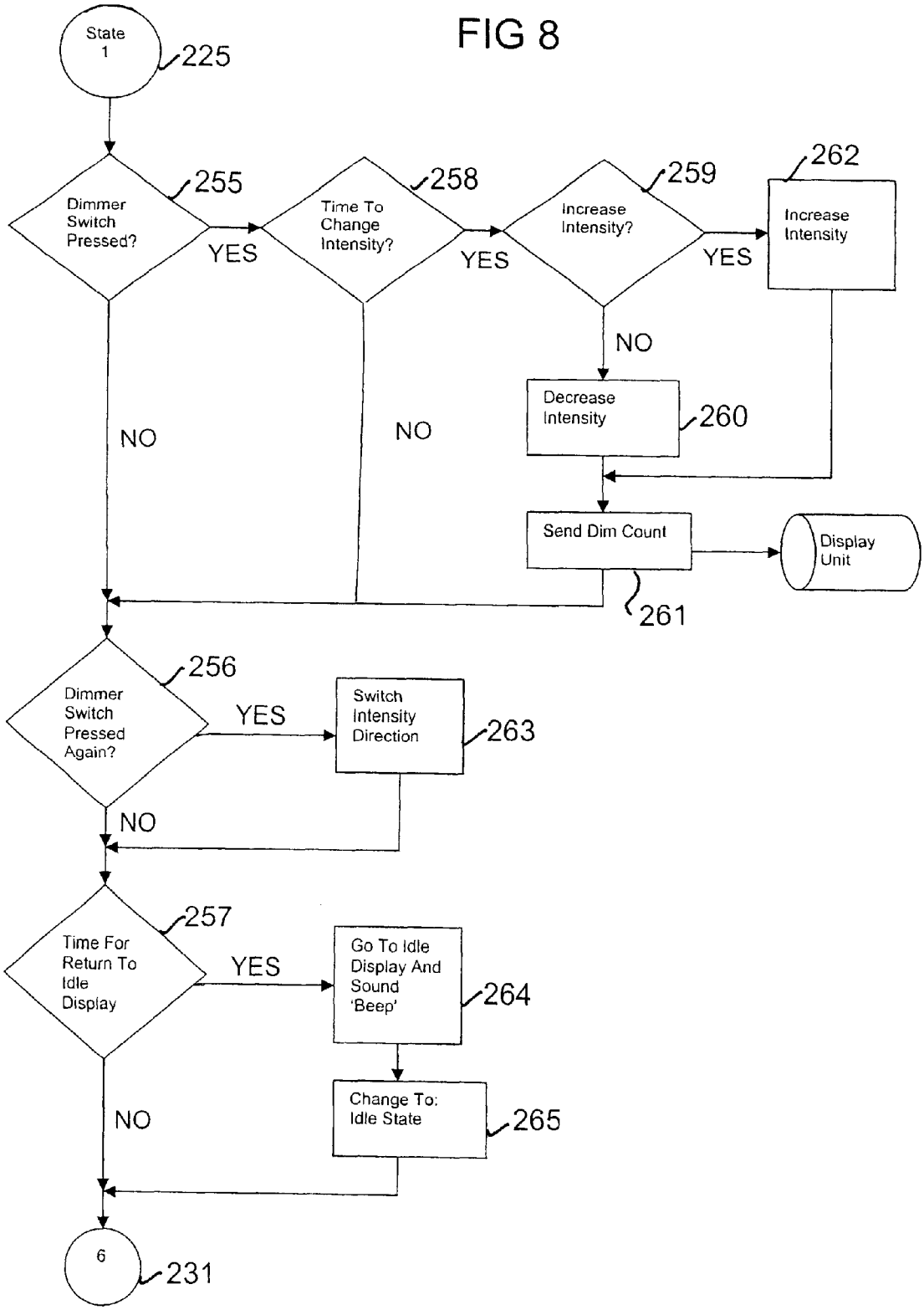
FIG. 8 sets forth a flow diagram of the control unit dimmer state portion of the present invention bilge pump monitor and alert system.

FIG. 8 sets forth a flow diagram of the dimmer state portion of the system program. It will be recalled that the dimmer state is entered at step 225 in response to a determination at step 220 in the main program loop (seen in FIGS. 6) that the dimmer state has been activated. At step 255, a determination is made as to whether the user has pressed the dimmer switch on the display unit. If not, the system moves to a step 256 in which a determination is made as to whether the user has pressed the dimmer switch a second time. If the determination at step 256 is negative, the system moves to step 257 in which a timer is examined to determine whether the system should return to idle display. If the time limit for dimmer switch activation has not expired, the system returns to main the program loop at step 231 and continues to return to step 225 from the main loop. As a result, in the event the system enters the dimmer state and the dimmer switch has not been pressed by the user, the system will move through steps 255, 256 and 257 of the dimmer state and return to the main program loop. If however a determination is made at step 255 that the dimmer switch has been pressed, the system moves to a step 258 in which the response timer is examined to determine whether intensity of illumination is to be changed. In the event an intensity change is to be made, the system moves to step 259 to determine whether intensity is to be increased. If the response at step 259 is negative, the system moves to step 160 decreasing intensity and thereafter moves to step 261 in which the dimmer count number is sent to the. display unit via the RS232 communication link. If however a determination is made at step 259 that intensity is increasing, the system moves to step 262 an increments an increase in intensity.

If at step 256 a determination is made that the user has pressed the dimmer switch a second time indicating a desire to reverse the direction of intensity of illumination change, the system moves to step 263 and switches the intensity direction. At step 257, the time to return to idle display is again examined and a positive determination causes the system to move to step 264 in which it returns to the idle display and sounds an audible beep tone. Thereafter, the system sets the idle state at step 265. Once the idle state has been set, the next time the system moves. through the main loop the idle state program will execute at step 230 unless a sensor input causes a change in state.

FIG. 9 sets forth a flow diagram of the set pump count limit stat e portion of the program. It will be recalled that the set pump count limit state is entered at step 226 following a determination at step 221 (seen in FIG. 6) in the main program loop that this state is to be-entered. Following step 226, the system moves to step 270 in which the pump alarm backlight is turned off and the pump set backlight is turned on. The system then moves to a step 271 in which the count for the bilge switch pressed by the operator is displayed. This count displayed is the present setting of the count. Thereafter, the system moves to step 272 in which a determination is made as to whether the pump set switch on the display unit has been pressed. If not, the system moves to a step 273 in which a determination is made as to whether a second pressing of the pump set switch has occurred. If a determination is made at step 273 that a second pump set switch pressing has not occurred, the system moves to a determination as to whether the minutes and days switch has been pressed. If the minutes and days switched has not been pressed, the system moves to a step 275 in which a determination is made as to whether the time set switch has been pressed. If a switch has not been pressed, the system moves to a determination at step 276 as to whether the timer for return to idle display has timed out. If not, the system returns to the main program loop at step 231. Thus, in the absence of the user having pressed the pump set switch or the minutes or days switch or the time set switch, the system will return to the main loop and continues to return to step 226 from the main loop.

If however the user has pressed the pump set switch on the display unit, the system moves from step 272 to step 277 and determines whether the timer for change count has timed out. If the timer has timed out, the system moves to step 273. If however time remains for changing the count limit, the system moves to step 278 to determine whether the system is increasing the count limit. If the system is not increasing the count limit at step 278, the system moves to step 279 and increments a decrease in the count limit. If however the system is increasing count limit at step 278, the system moves to step 280 and incrementally increases the count limit.

If at step 273 a determination is made that the user has pressed the pump set switch a second time indicating a desire to change the count direction increment, the system moves through step 281 in which the count direction is switched. In the event a determination is made at step 274 that the user has pressed the minutes and days switch at the same time on the display unit, the system resets all pump count limits at step 282.

In the event the user has pressed the time set switch, the system moves from step 275 through steps 283 and 284 in which the idle display and sound beep are activated and the idle state is set and the system returns to the main loop. As the system moves through the main loop (seen in FIG. 6) the set idle state will cause the system to enter the idle state at step 230 (seen in FIG. 6).

FIG. 10 sets forth a flow diagram of the set pump on time limit state portion of the program. As mentioned above, the set pump on time limit state is entered through step 222 in the main program loop (seen in FIG. 6) at a step 227. Following step 227, the system moves to step 290 in which the pump alarm backlight is turned off and the time set backlight is turned on. Thereafter, at step 291, a determination is made as to whether the alarm mute backlight is on. If not, the system moves to step 292 and determines whether the bilge backlight is on. If the bilge backlight is not on, the system moves to step 293 and determines whether the time set switch has been pressed. If the time set switch has not been pressed, a determination is made at step 294 as to whether the time set switch has been pressed again. In the absence of time set switch pressing, a determination is made at step 295 as to whether the minutes and days switch has been pressed. If not, the system moves to step 296 and determines whether the pump set switch has been pressed. In the absence of the pump set switch having been pressed, the system moves to step 297 and determines whether the time interval for return to idle display has timed out. If the time limit has not transpired, the system returns to the main program loop at step 231.

Thus in the absence of the user having pressed either the alarm mute, a bilge switch, time set switch, minutes and days switch, or pump set switch, the system moves through steps 290 through 297 and returns to the main program at step 231. In the event however appositive determination is made at any one of steps 291 through 296, the system then branches to the appropriate portion of the program. Thus, for example, in the event it is determined at step 291 that the alarm mute backlight is on, the system moves to step 298 and the bilge backlight is turned off and the alarm mute time is displayed. In the event a determination is made at step 292 that the bilge backlight is on, the system moves to step 299 in which the mute backlight is turned off and the time limit for the selected bilge pump is displayed. In the event the time set switch is pressed once, the system moves from step 293 to step 300 in which a determination is made as to whether sufficient time remains to change the time limit. In the event time remains, the system moves to step 301 at which point a determination is made as to whether an increasing change is occurring. If the increasing change is not occurring, the system moves to step 302 and incrementally decreases the time limit setting. If however the system is increasing the limit at step 301, the system moves to step 303 and incrementally increases the time limit. The time limit setting applies to the alarm mute time if the alarm mute backlight was on or to the appropriate bilge if a bilge backlight was on.

In the event a determination is made at step 294 that the user has pressed the time set switch a second time, the system moves to step 304 in which the count direction is switched. If at step 295 a determination is made that the user has pressed the minutes and days switch at the same time, the system moves to step 305 and resets all pump time limits. At step 296, a determination that the pump set switch has been pressed, causes the system to move to step 306 in which the system moves to idle display and produces a sound beep. At step 307, the system sets the idle state. Thereafter, the system returns to the main program loop through step 231. With the idle state set, the system will enter the idle state from the main loop at step 230 (seen in FIG. 6).

FIG. 11 sets forth a flow diagram of the pump on state portion of the program, it will be recalled that the pump on state is entered at step 228 following a determination at step 223 (seen in FIG. 6) within the main program loop. At step 310, the system updates pump on times for active pumps. Thereafter, the system moves to a step 311 in which a determination is made as to whether any bilge pump is still on. If no bilge pump is active, the system moves to step 312 and moves to idle display and produces a sound beep. Thereafter, the system sets the idle state at step 313 returns to the main program loop at step 231.

If however a determination is made at step 311 that a bilge pump is still on, a determination is made at step 314 as to whether any alarm is on. If an alarm is on, the system moves to step 315 in which the check alarm sub-routine is called. Thereafter, the system moves to step 316 in which the pump alarm. sub-routine is called. Following the check alarm and pump alarm calls, the system moves to step 317 in which a determination is made as to whether a bilge switch has been pressed. If no bilge switch has been pressed, the system returns to the main program loop at step 231. If however a bilge switch has been pressed, the system moves to step 323 to determine whether the selected pump corresponding to the pressed bilge switch is on. If the selected bilge pump is on, the system returns to the main program loop at step 231. If however the selected pump is not on, the system moves to step 324 to determine whether the reset time has expired. If the reset time has expired, the system moves to step 325 and resets the selected bilge pump count and on time. The system then moves to step 326 and displays the bilge pump count. In the event the reset time has not expired at step 324, the system bypasses step 325 and moves directly to step 326. Following step 326, the system returns to the main program loop at step 231.

Returning to step 314 in the event no alarms are found active, the system moves to step 318 in which a determination is made as to whether the mute switch of the display unit has been pressed. In the event the mute switch has been pressed, the system moves to step 319 and the mute beep control is toggled. In the event the mute switch is not pressed, the system bypasses step 319 and moves directly to step 320. At step 320, the bilge pump backlight for the active pump is blinked. In addition, at step 320 the pump on count is displayed. At step 321 a determination is made as to whether the beep tone is to be muted. If not, the system moves to step 322 in which a periodic beep tone is produced while the pump is active. If a mute beep tone is determined at step 321, the system bypasses step 322 and moves to step 317.

Figure 12:
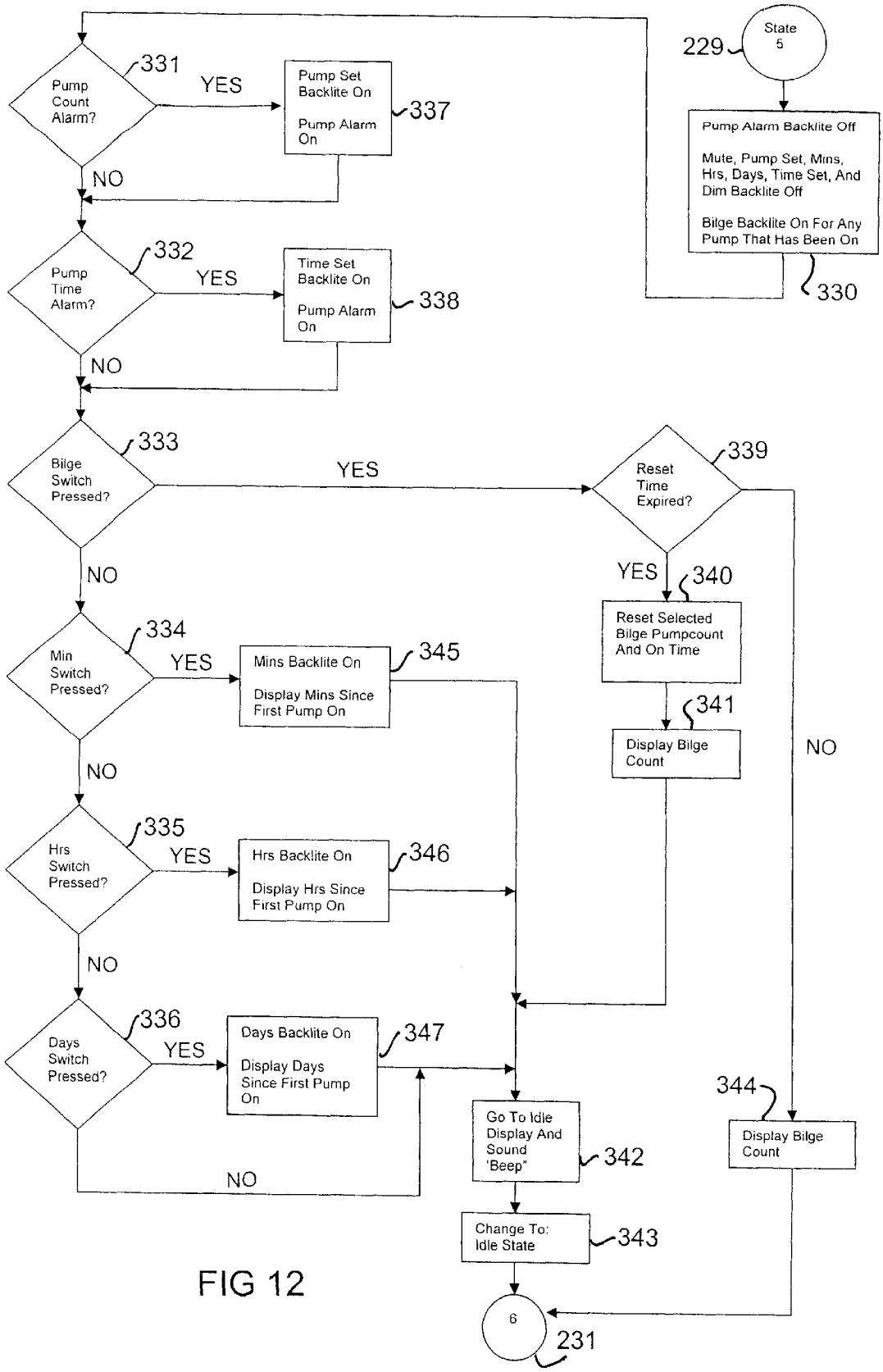
FIG. 12 sets forth a flow diagram of the control unit display current pump counts portion of the present invention bilge pump monitor and alert system.

FIG. 12 sets forth a flow diagram of the display current pump counts state portion of the program. It will be recalled that the display current pump counts state is entered at step 229 following step 224 (seen in FIG. 6) of the main program loop. Following step 229, at step 330 initial settings are made which include turning the backlight off for the pump alarm, mute, pump set, minutes, hours, days, time set and dimmer. In addition, the bilge backlight is turned on for any pump which has been activated. Following the initialization at step 330, the system moves to a step 331 in which a determination is made as to whether there is a pump count alarm. That is to say, whether any bilge pump has been activated for a number of cycles exceeding the preset count limit. If the pump count alarm level has not been exceeded, the system moves to step 332 in which a determination is made as to whether any pump has been operated for a time period exceeding the alarm level. If not, the system moves to step 333 in which a determination is made as to whether a bilge switch has been pressed. If no bilge switch has been pressed, the system sequentially determines whether the minutes, hours or days switch has been pressed at steps 334, 335 and 336. If none of the switches has been pressed, the system moves to step 342 in which the beep tone is sounded and the system moves to idle display. Thereafter, at step 343, system sets to the idle state and returns to the main program loop at step 231.

If at step 331 a determination is made that the pump count alarm limit has been exceeded, the system moves to step 337 at which the pump set backlight is turned on and the pump alarm is activated. In the event a determination is made at step 332 that a pump has been operated for a time interval exceeding the alarm pump time, the system moves to step 338 at which the time set backlight is turned on and the pump alarm is activated.

In the event it is determined at step 333 that a bilge switch has been pressed, the system moves to step 339 and a determination is made as to whether the reset time has expired. If the time has not expired, the system moves to step 344 and the bilge count is displayed. If however the reset time has expired, the system moves to step 340 and resets the pump count and on times for the selected bilge. Thereafter, at step 341, the bilge count is displayed and the system moves to step 342.

Steps 334, 335 and 336 provide determinations as to whether the minutes, hours or days switches have been pressed. In the event the minute switch has been pressed, the system moves to step 345 at which the minutes backlight is turned on and the number of minutes since first pump activation is displayed for the last bilge switch pressed. In the event the hours switch has been pressed, the system moves to step 346 and the hours backlight is turned on and the number of hours since first pump activation is displayed for the last bilge switch pressed. Similarly, in the event the days switch is pressed, the system moves to step 347 and the days backlight is turned on and the number of days since first pump activation is displayed for the last bilge switch pressed. Following each of steps 345, 346 and 347, the system moves to step 342.

Figure 13:
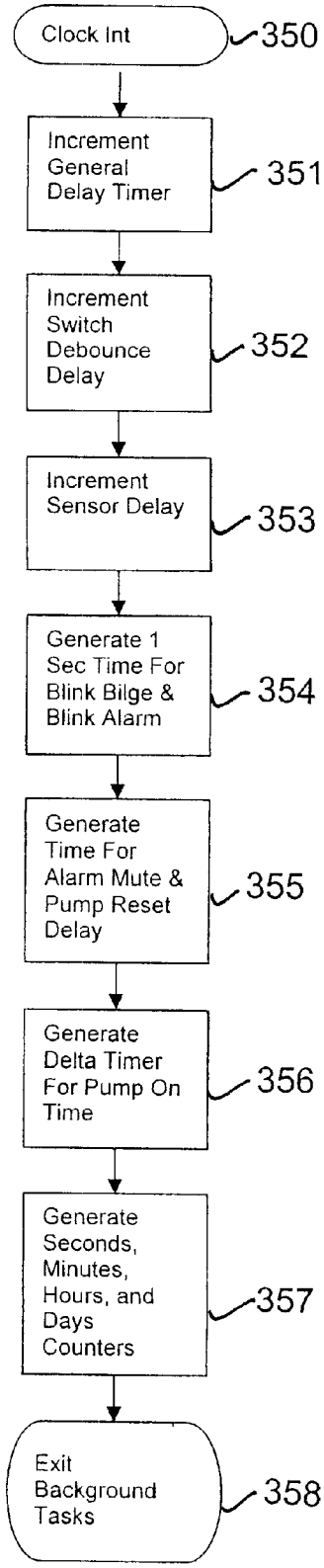
FIG. 13 sets forth a flow diagram of the control unit clock interrupt sub-routine of the present invention bilge pump monitor and alert system.

FIG. 13 sets forth the real time clock interrupt portion of the program. This portion of system operation is maintained by an internal crystal controlled clock and counter. Internal times established within the processor unit of the control unit microprocessor provides periodic automatic interrupts of the ongoing program activities to execute the various housekeeping functions set forth in the clock interrupt portion of the program. It will be noted that clock interrupt occurs in response to the expiration of an interrupt time interval which in the present invention is slightly more that thirteen milliseconds and does not require any user input to activate the clock interrupt.

The clock interrupt is initiated following the expiration of an interrupt time interval at step 350, following which the general delay timer is incremented at step 351. The general delay timer provides a number of delay timers operative within the system. At step 352, the switch debounce delay timer is incremented. The switch debounce delay provides a short time period delay following the pressing of any switch by the user to ensure that the switch has been intentionally pressed and to eliminate noise which might otherwise falsely trigger an event within the system. Thereafter, at step 353 the sensor delay timer is incremented. The sensor delay timer provides a similar function for avoiding noise triggering and for filtering the sensor inputs to the system as is provided by the switch debounce delay. Next at step 354, a timer is operated for generating the on/off backlight flashing functions provided within the system. At step 355, a time interval for alarm mute and pump reset delay is generated. This reset delay is operative to limit the time interval for which the user may mute the system alarm in the presence of a continuing alarm circumstance. Thereafter, at step 356, a delta timer or difference timer for pump on time is generated. This establishes six on times for the six bilge pumps. At step 357, the clock time for use in recording the minutes, hours and days since the first activation of each of the six bilge pumps is incremented. The program returns to the operative portion of the program prior to interrupt at a step 358.

Figure 14:
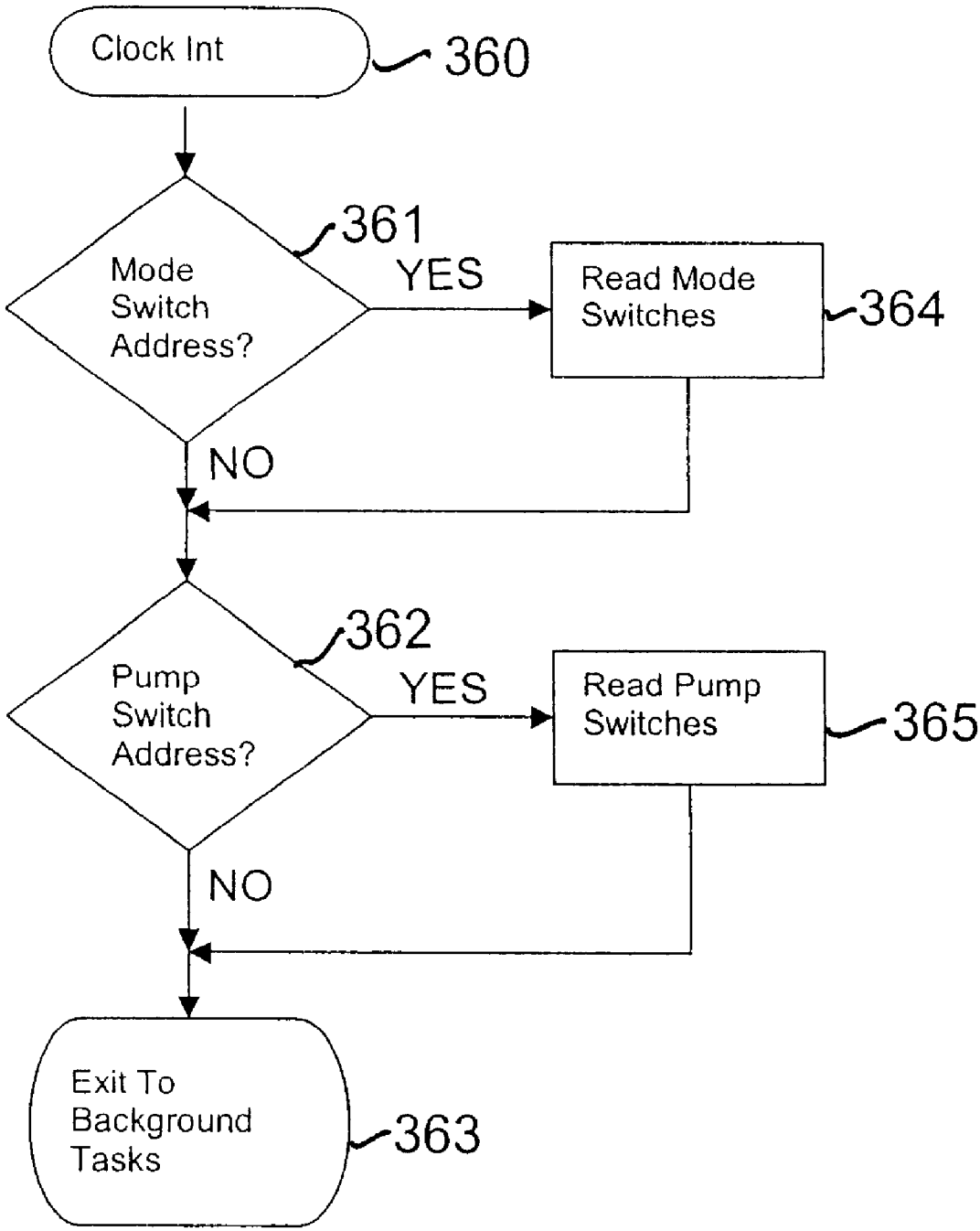
FIG. 14 sets forth a flow diagram of the control unit communication interrupt sub-routine of the present invention bilge pump monitor and alert system.

FIG. 14 shows the RS232 serially receive interrupt portion of the system program. It will be noted that the use of a receive interrupt within the operation of the control unit avoids the need for the control unit to conduct polling of the inputs of the display unit. Thus, each time an input is activated by the user at the display unit, the system exercises a receive interrupt at the control unit.

Thus, at step 360, the system receives an interrupt indicating that a user input has occurred at the display unit. In response to the interrupt at step 36Q, the current task of the processor is interrupted. At step 361, a determination is made as to whether a mode switch address has been provided. If not, the system moves to step 362 for a determination as to whether a pump switch address has been provided. If neither has been provided, the system exits the interrupt and returns to the background tasks at step 363. If however a mode switch address is received at step 361, the system moves to a step 364 and reads the mode switches. Similarly, if a pump switch address is determined at step 362, the system moves to step 365 and reads the pump switches.

Figure 15:
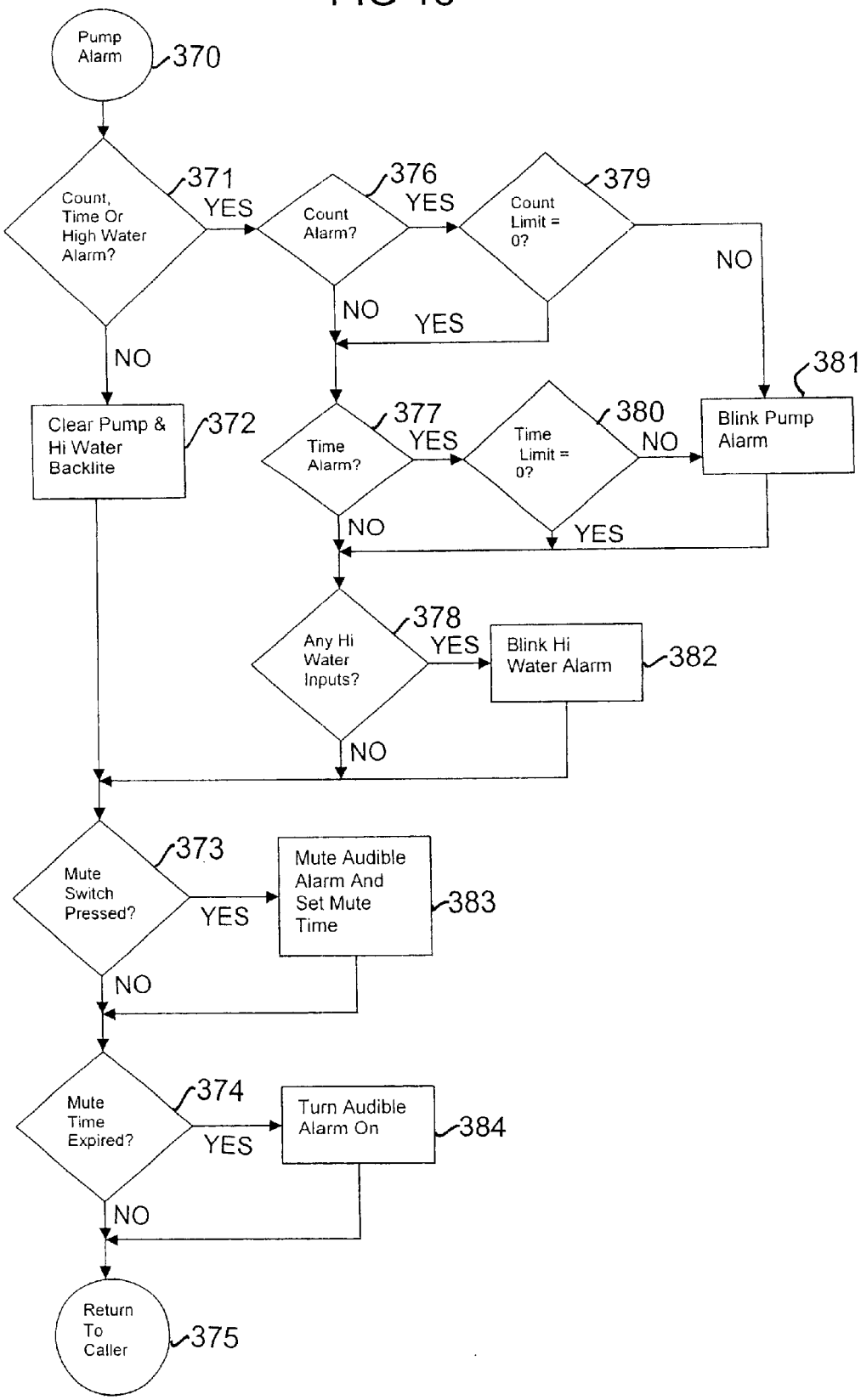
FIG. 15 sets forth a flow diagram of the control unit set pump alarm of the present invention bilge pump monitor and alert system.

FIG. 15 sets forth a flow diagram of the pump alarm sub-routine of the system program. The pump alarm sub-routine is entered at step 370 after which a determination is made at step 371 as to whether a count, time or high water alarm has occurred. If not, the system moves to a step 372 and the backlights are cleared for the pump and high water indicators. At step 373, a determination is made as to whether the mute switch has been pressed. If not, a determination is made at step 374 whether the mute timer has expired. If the mute time has not expired, the system moves to step 375 returning to the point in program operation at which the pump alarm sub-routine was called.

If however a determination is made at step 371 that an alarm has occurred, the system moves to step 376 to determine whether the alarm is a count alarm. If not, the system moves to step 377 to determine whether the alarm is a time duration alarm. If the alarm condition is not a pump time alarm, the system moves to step 378 for a determination as to whether the alarm is a high water alarm from any of the high water switches within the host vessel. In the event there is no high water alarm, the system returns to step 373.

If at step 376 it is determined that the alarm condition is a pump count, the system moves to step 379 and determines whether the count limit has been set to zero. If the count limit has been set to zero, the system disables the count alarm and moves to step 377. If however the count limit has not been set to zero, the system moves to step 381 and blinks the pump alarm indicator.

If at step 377 a determination is made that the alarm is a pump time alarm, the system moves to step 380 for a determination as to whether the pump time limit has been set to zero. If it has, the system moves to step 378. If the time limit has not been set to zero, the system moves to step 381 and blinks the pump alarm. If at step 378 a determination is made that a high water input alarm condition exists, the system moves to step 382 and blinks the high water alarm.

If at step 373 a determination is made that the mute switch has been pressed, the system moves to step 383 and mutes the alarm and sets a mute time and then moves to step 374. If at step 374 a determination is made that the mute time has expired, the system moves to step 384 and restores the audible alarm. Thereafter, the system returns to the caller at step 375.

FIG. 16 sets forth a flow diagram of the check pumps sub-routine. As mentioned above, sub-routines are called periodically throughout the program to implement a particular sequence of steps after which the system returns to the task being executed at the time of call. Thus, FIG. 16 sets forth the sub-routine which takes place each time the system needs to determine whether a bilge pump is active. Commencing at a step 385 which initiates the check pumps sub-routine, the system moves to step 386 for a determination as to whether any pump is active. In the event no pump is active, the system moves to a step 387 returning to the caller and continuing with the current task. In the event however, a determination is made that a pump is active, the system moves to a step 388 in which the count history of the active pump is incremented and the pump on state is set to true. Thereafter, the system returns to the caller at step 387.

FIG. 17 sets forth a flow diagram of the check alarms sub-routine. The check alarm sub-routine is initiated at a step 390, after which a determination is made at a step 391 as to whether any pump count exceeds the alarm limit. In the event the alarm limit is not exceeded on any pump, the system moves to a step 392 at which a determination is made as to whether any pump time has exceeded the pump time alarm limit. If not, the system returns to the caller at a step 393. If however it is determined at step 391 that the pump count limit for any pump has been exceeded, the system moves to step 394 and sets the count alarm. Thereafter, the system moves to step 392. In the event a determination is made at step 392 that a pump time alarm limit has been exceeded, the system moves to step 395 in which the time alarm is set. Either the set count alarm or set time alarm occurring in steps 394 and 395 produces the above described alarm activity.

FIG. 18 sets forth the decode switch sub-routine of the system program. Beginning at step 396 when the decode switches program is called, the system sets the backlight data at step 397 and thereafter sets variables used for processing switch inputs at steps 398. The system then returns to the program caller at step 399.

Figure 19:
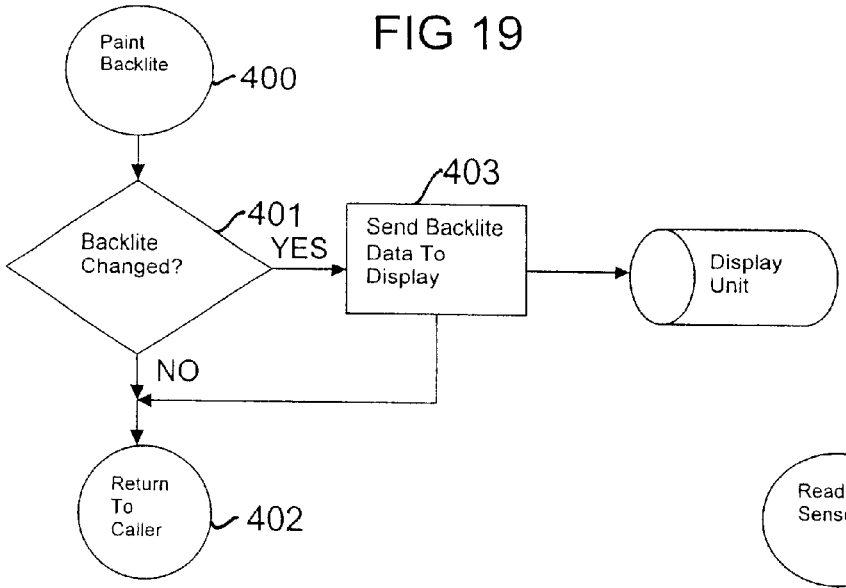
FIG. 19 sets forth a flow diagram of the control unit paint backlight portion of the present invention bilge pump monitor and alert system.

FIG. 19 sets forth the paint backlights sub-routine of the system program. The paint backlight sub-routine is initiated when called at a step 400 after which a determination is made at step 401 as to whether the backlight has changed. In the event the backlight has not been changed for the display unit, the system returns to the program caller at step 402. In the event however the backlight has changed, the system moves from step 401 to step 403 in which the backlight data is sent to the display unit. As described above, communication from the control unit to the display unit is provided via a RS232 serially port as indicated in FIG. 19.

Figure 20:
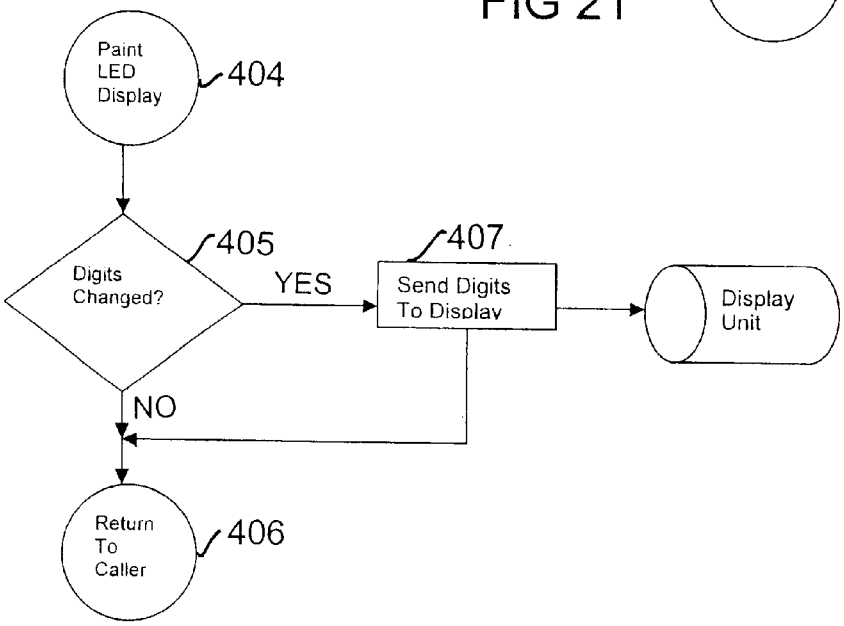
FIG. 20 sets forth a flow diagram of the control unit paint LED portion of the present invention bilge pump monitor and alert system.
Figure 22:
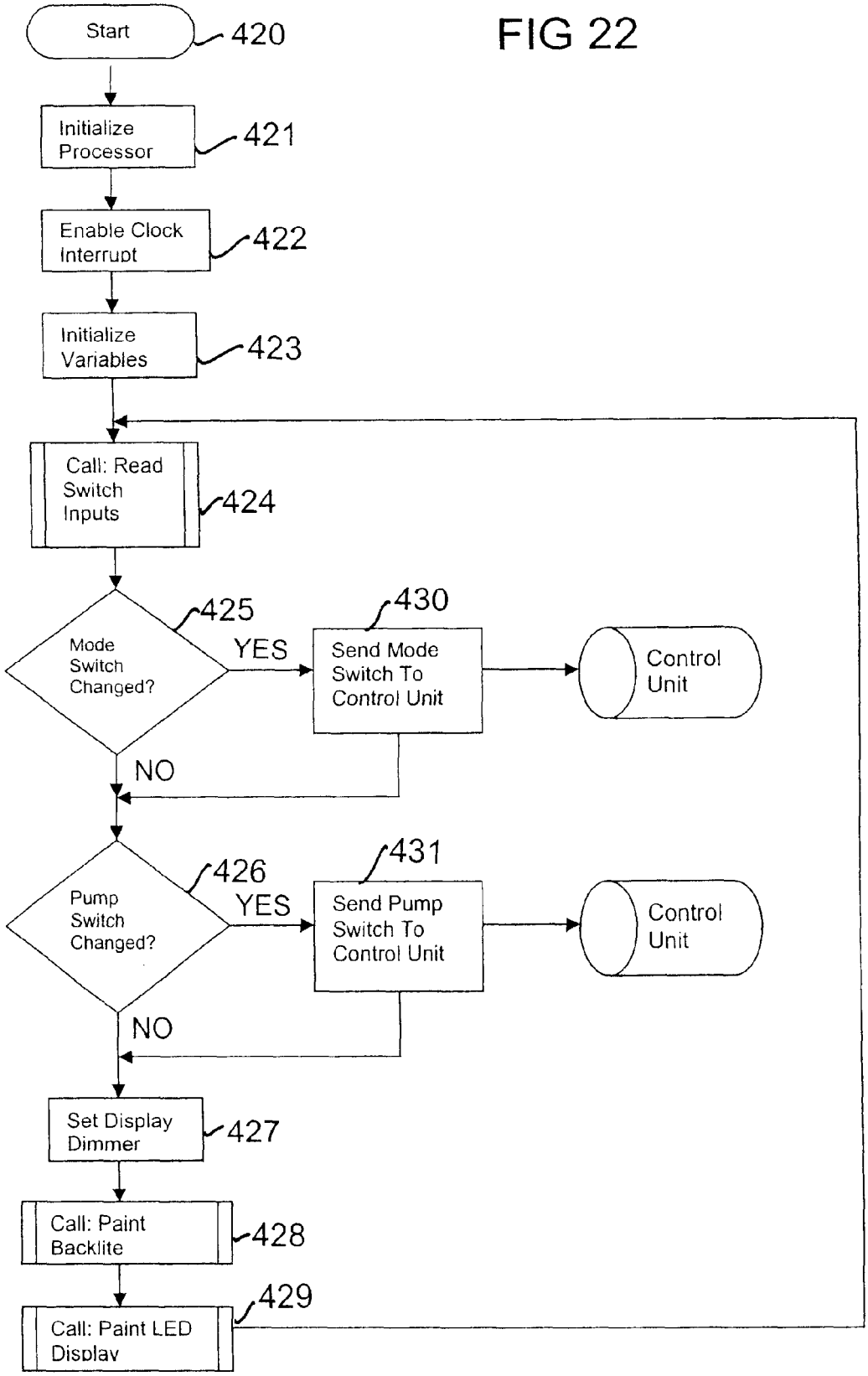
FIG. 22 sets forth a flow diagram of the display unit main loop portion of the present invention bilge pump monitor and alert system.

FIG. 20 sets forth the paint LED sub-routine of the system program. When called, the paint LED (light emitting diode) of the display is initiated at a step 404 after which the system determines at step 405 whether the digits of the LED display need to be changed. In the event no change is required, the system returns to the program caller at step 406. If however the digits of the display need to be changed, the system moves to a step 407 in which the digits are communicated to the display unit via the RS232 communication link as indicated in FIG. 20.

Figure 21:
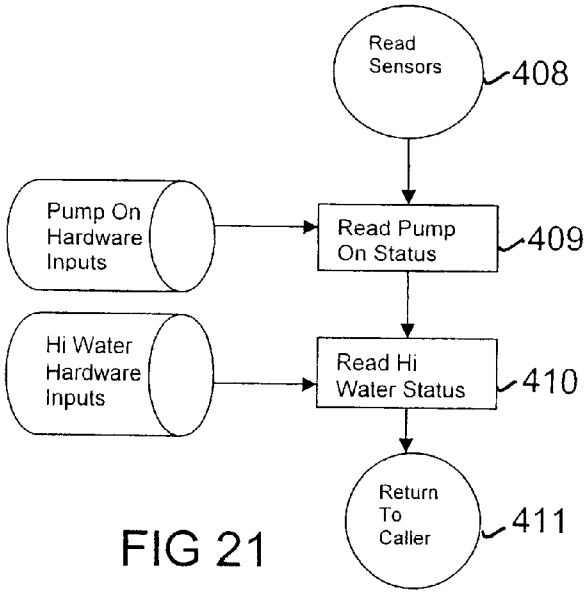
FIG. 21 sets forth a flow diagram of the control unit read sensors state portion of the present invention bilge pump monitor and alert system.

FIG. 21 sets forth the read sensors sub-routine of the system program which is initiated at a step 408 in which the read sensors sub-routine is called. Thereafter, the system moves to a step 409 in which the pump on status is read. The pump on status is derived from the pump on hardware inputs described above. In essence, this is the characteristic of the bilge pump system which provides a signal indicating an active bilge pump. Following the read at step 409, the system moves to step 410 in which the high water status is read. Once again, the high water status is provided by the plurality of high water switches forming a portion of the hardware of the present invention system described above.

At this point, the operation of the processor within control unit 11 shown in FIG. 4A has been described in the flow diagrams FIGS. 6 through 21. As will be further described below, the majority of the flow diagrams set forth in FIGS. 6 through 21 are also applicable to control unit 180 shown in the alternate embodiment of FIG. 5A. The difference in the operation of control unit 180 shown in FIG. 5A will be set forth below. However, suffice it to note here, that all of FIGS. 6 through 21 are applicable to control unit 180 with the exception of FIGS. 6, 8 and 14.

With the above described operation of control unit 11 in the flow diagrams of FIGS. 6 through 21, the operation of the cooperating display unit 12 shown in FIG. 4B may now be described. More specifically, FIG. 22 sets forth a flow diagram of the main program loop for the display unit processor of the present invention system embodiment shown in FIG. 4B. By way of overview, the basic operation of the display unit within the present invention system is to receive user inputs via the membrane switch panel shown in FIG. 2 and communicate the corresponding input data to the control unit via the RS232 communication link. Additionally, the display unit of the present invention system functions to maintain and configure the backlighting of indicators and switches upon the membrane switch panel of the control unit at the correct intensity level (seen in FIG. 2).

Beginning at step 420, the system begins and initializing process at a step 421 in which the display unit processor is initialized. Thereafter, at step 422, the clock interrupt is enabled and at step 423 the system variables are initialized. This initializing of variables for the most part requires a reset, to zero. Steps 420 through 423 represent a sequence of steps which is carried forward each time the display unit is powered up. Thereafter, the remaining steps shown in FIG. 22 form the actual loop portion of the main program loop for the display unit. At step 424, the read switch inputs sub-routine is called. Once the read switch inputs sub-routine (seen in FIG. 27) is complete, the system moves to a step 425 for a determination as to whether the mode switch has been changed. In the event the mode switch has not been changed, the system then determines at step 426 whether the pump switch has been changed. If the pump switch has not been changed, the'system moves to a step 427 to set the display dimmer. Thereafter, at step 428, the system calls the paint backlight sub-routine (seen in FIG. 25). Once the paint backlight sub-routine has been completed, the system moves to step 429 and calls the paint LED display sub-routine shown in FIG. 26. At the completion of the paint LED display sub-routine, the system returns to step 424. Thus, in the absence of a change of mode switch or pump switch configuration, the display unit processor cycles through the main loop formed by steps 424 through 429. Once mode switch 425 has changed, the system moves to step 430 in which the mode switch information is communicated to the control unit via the RS232 communication link. Thereafter, the system moves to step 426 and continues. In the event the pump switch configuration has changed, the system moves to step 431 in which the pump switch change information is communicated to the control unit via the RS232 communication link. Thereafter, the system moves to step 427 and continues through the main program loop as described above.

Figure 23:
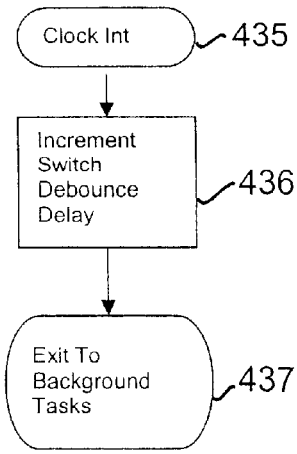
FIG. 23 sets forth a flow diagram of the display unit clock interrupt portion of the present invention bilge pump monitor and alert system.

FIG. 23. sets forth -the real time clock interrupt of the display unit processor. The concept of real time clock interrupt for the display unit is substantially the same as the real time interrupt set forth above in FIG. 13 for the control unit. The primary difference in the clock interrupt of the display unit processor is the substantially smaller number of timers being maintained. Thus, the clock interrupt is initiated at step 435 in response to the basic clock at which point the task in progress is interrupted and the system moves to a step 436 in which the debouce delay timer for switch input is incremented. Thereafter, the system returns to the background tasks in progress at step 437. The switch debounce delay timers provide noise immunity for the system by introducing a small delay interval following switch activation to ensure that the system is not responding to noise or other inadvertent switch signals.

Figure 24:
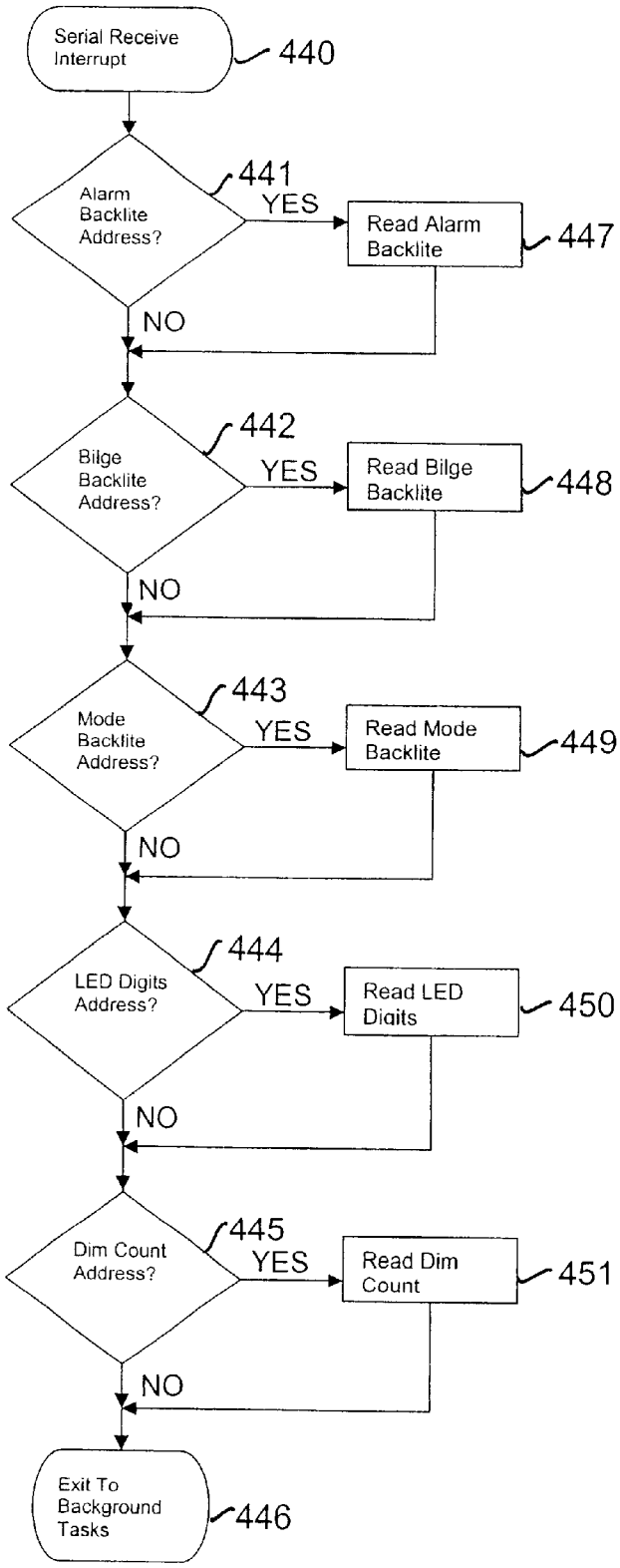
FIG. 24 sets forth a flow diagram of the display unit receive interrupt portion of the present invention bilge pump monitor and alert system.

FIG. 24 sets forth the RS232 receive interrupt for the display unit processor. Once again, the interrupt for the display unit processor is similar in principle to the interrupt for the control unit processor set forth above in FIG. 14. The intention is to periodically interrupt the processor activity within the display unit when information is to be communicated between the control unit and the display unit via the RS232 communication link. The use of this interrupt avoids the need for polling the control unit.

Once a serial receive interrupt is received at step 440, the system moves to a step 441 in which a determination is made as to whether the data includes alarm backlight address data. If not, the system determines at step 442 whether the data includes bilge backlight address data. If not, the system moves to step 443 and determines whether the data includes mode backlight address data. If mode backlight address data is not found, the system moves to step 444 to determine whether LED digit address data is found within the communication. If not, the system the determines at step 445 whether the data includes dimmer count address data. If no dimmer count address data is found, the system exits to the current task at step 446. Thus, the receive interrupt cycles through steps 440 through 446 and returns to the current task in the absence of address data in the communication received as an interrupt. If however alarm backlight address data is found at step 441, the system moves to step 447 and reads the alarm backlight data. The system then moves to step 442. If a determination is made at step 442 that bilge backlight address data is present, the system moves to step 448 in which the bilge backlight address data is read. The system then returns to step 443. If at step 443 mode backlight address data is found, the system moves to step 449 and reads the mode backlight data. If at step 444 LED digit addresses are found, the system moves to step 450 and reads. the LED digits and moves to step 445. If at step 445 dimmer count address data is found, the system moves to step 451 and reads the dimmer count. Thereafter, the system exits the current task at step 446.

Figure 25:
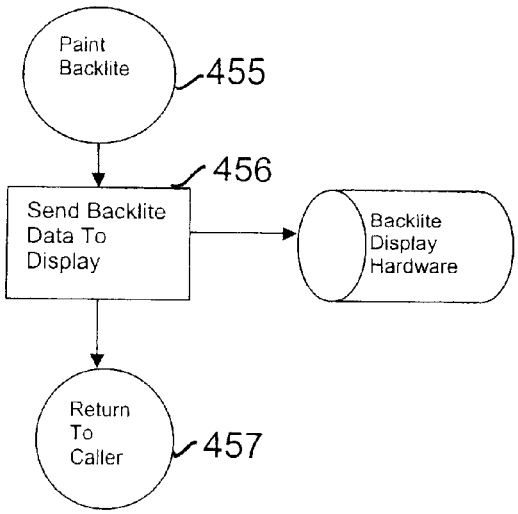
FIG. 25 sets forth a flow diagram of the display unit paint backlight sub-routine of the present invention bilge pump monitor and alert system.

FIG. 25 sets forth the paint backlights sub-routine of the display unit processor. Paint backlights is a sub-routine called as step 428 in the main program loop of the display unit processor shown in FIG. 22. Beginning at a step 455, the system moves to step 456 in which backlight data is applied to the backlight display hardware within the membrane switch array of the display unit (seen in FIG. 20). Thereafter, the system moves to step 457 and returns to the program caller.

Figure 26:
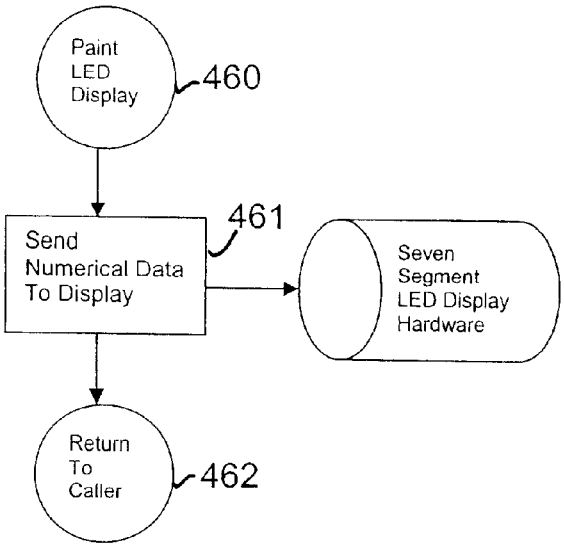
FIG. 26 sets forth a flow diagram of the display unit paint LEDs sub-routine of the present invention bilge pump monitor and alert system.

FIG. 26 sets forth a flow diagram of the paint LED display sub-routine of the display unit processor. The paint LED display sub-routine is called as step 429 in the display unit main program loop shown in FIG. 22. Beginning at a step 460, the sub-routine is entered and at step 461 the numerical data is communicated to the seven segment LED display hardware which comprises the numeric display portion of display unit 12 shown in FIG. 2. The system then returns to the program caller at step 462.

Figure 27:
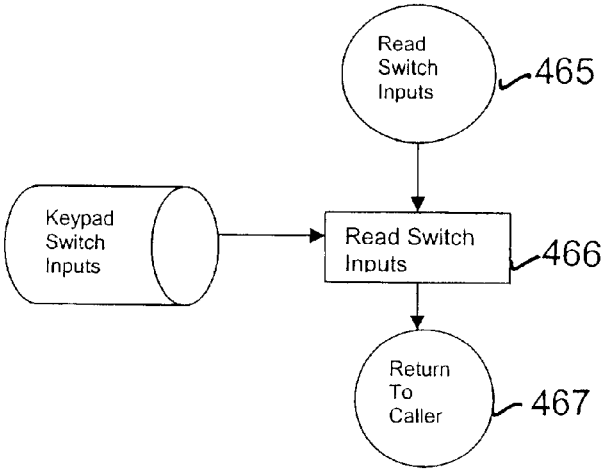
FIG. 27 sets forth a flow diagram of the display unit read switch input sub-routine of the present invention bilge pump monitor and alert system.

FIG. 27 sets forth a flow diagram of the read switch inputs sub-routine. The read switch inputs sub-routine is called by a program call at step 424 of the main program loop of the display unit processor shown in FIG. 22. Beginning at step 465, the system moves to step 466 at which point the switch inputs are read from the display unit membrane switch panel shown in FIG. 2. Following the switch input read the system returns to the program caller at step 467.

Figure 31:
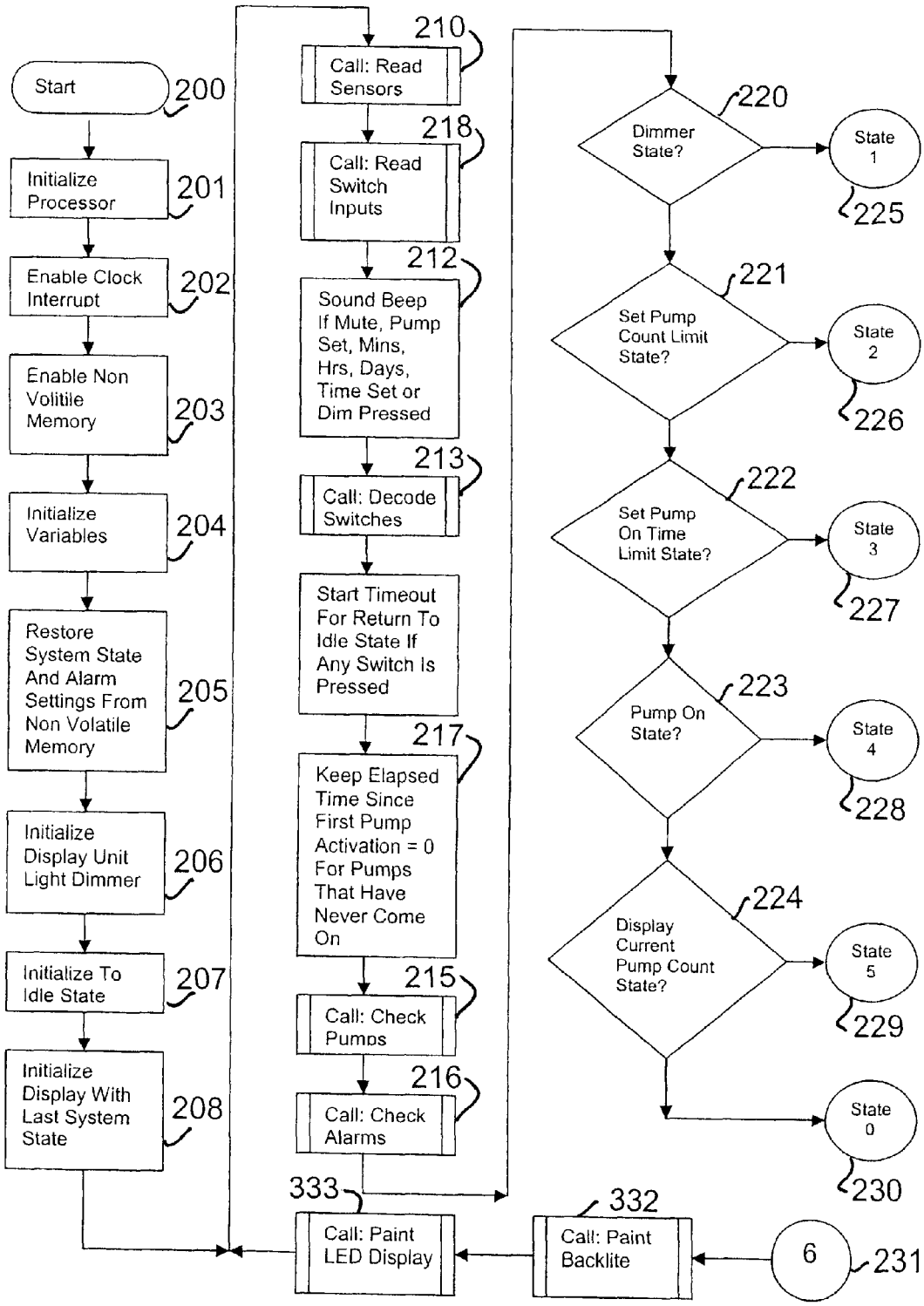
FIG. 31 sets forth a flow diagram of the control unit main loop portion of the embodiment of the present invention bilge pump monitor and alarm system set forth in FIG. 5A.

At this point, the flow diagram information of the operations both the control unit processor shown in FIG. 4A and the display unit processor shown in FIG. 4B of the preferred embodiment of the present invention system have been described. In the flow diagrams applicable to the alternate embodiment shown in FIGS. 5A and 5B which follow, FIG. 7, FIGS. 9 through 13, and FIGS. 15 through 18 will apply equally well to the alternate embodiment of the present invention system set forth in FIGS. 5A and 5B. Also, the main loop portion of the control unit shown in FIG. 5A which is set forth in FIG. 31 is identical to FIG. 6 with the exception of step 218 between steps 210 and 211. It will be recalled that the primary difference between the embodiment of FIGS. 4A and 4B and the alternate embodiment of FIGS. 5A and 5B is found in the absence of a display unit processor and RS232 communication link in the alternate embodiment of FIGS. 5A and 5B.

Figure 28:
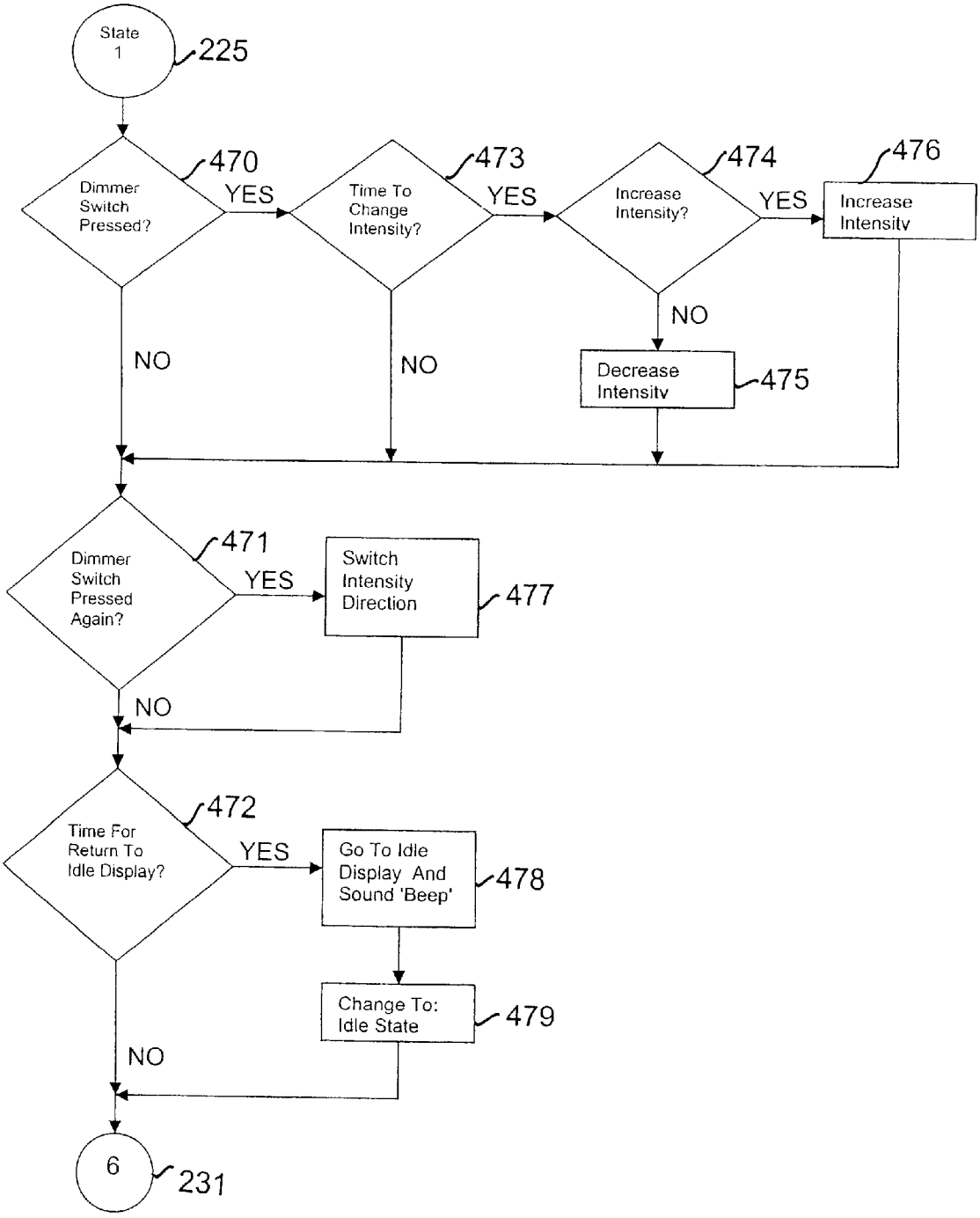
FIG. 28 sets forth a flow diagram of the control unit dimmer state portion of an alternate embodiment of the present invention bilge pump monitor and alert system.

Thus, with respect to the flow diagram operation of control unit 180 of the alternate embodiment of the present invention set forth in FIG. 5A, FIG. 31 replaces FIG. 6 as the main loop of the program while FIG. 7 described above set forth the idle state portion of the system program. FIG. 28 sets forth the dimmer state portion of the control unit processor for the alternate embodiment control unit shown in FIG. 5A. Comparison of FIG. 31 and FIG. 6 shows that the main loop of FIG. 31 differs solely in the addition of step 218 following step 210. Thus, but for this difference, the descriptions of the main loop of FIG. 6 apply equally well to the main loop of FIG. 31. Similarly, comparison of FIGS. 28 and 8 shows that the sole difference is found in the absence of step 261 and RS232 communication to the display unit. Thus,returning to FIG. 28, the dimmer state is initiated at state 225 following state 220 (seen in FIG. 31). Thereafter, the system moves to step 470 in which a determination is made as to whether the dimmer switch has been pressed. In the event the dimmer switch has not been pressed, the system moves to step 471 to determine whether the dimmer switch has been pressed a second time. If not, the system moves to step 472 in which a timer is examined for a determination to whether the time for return to idle display has occurred. If not, the system returns to the main program loop at a step 231. Thus, in the absence of the users operation of the dimmer switch, the system proceeds from step 225 through steps 470 through 472 and returns to the main program loop at step 231.

If however a determination is made at step 470 that the dimmer switch has been pressed, the system moves to step 473 to determine whether time for intensity change is available. If not, the system moves to step 471. If however time remains, the system moves to step 474 to determine whether the change is to be an increase. If not, the system moves to step 475 at which the intensity if decreased incrementally. If however and increase of intensity is in process at step 474, the system moves to step 476 and the illumination intensity is incrementally increased. In either case, the system moves to step 471. In the event a determination is made at step 471 that the dimmer switch has been pressed a second time, the system moves to step 477 and switches the direction of intensity change. Thereafter, the system moves to step 472. In the event a determination is made at step 472 that it is time for return to idle display, the system moves to step 478 and moves to idle display while sounding an audible beep tone. Thereafter, the system moves to step 479 at which the idle state number is set in the main program loop (FIG. 31). The system returns to the main program loop at step 231 and at step 230 the system will enter the idle state.

The flow diagram set forth in FIGS. 9 through 13 and described above and apply equally well to the pump count, pump set on time, pump on state, display current pump and clock interrupt portion of the program for the alternate embodiment control unit of FIG. 5A. Further, the flow diagrams set forth in FIGS. 15 through 18 described above apply equally well to the alternate embodiment control unit set forth in FIG. 5A. Thus, FIGS. 15 through 18 set forth the sub-routines for pump alarm, check pump, check alarm and decode switches used in the alternate embodiment control unit of FIG. 5A.

Figure 29:
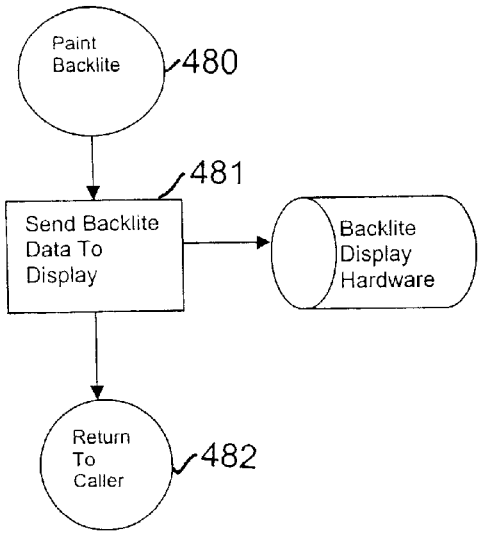
FIG. 29 sets forth a flow diagram of the control unit paint backlights sub-routine of an alternate embodiment of the present invention bilge pump monitor and alert system.

FIG. 29 sets forth a flow diagram for the paint backlight sub-routine of the control unit of FIG. 5A. The paint backlight sub-routine is entered at a step 480 after which the system moves to step 481 in which the backlight data is communicated directly to the backlight display hardware of the display unit. It will be noted that the paint backlight sub-routine of the alternate embodiment of FIG. 5A does not utilize the RS232 communication link.

Figure 30:
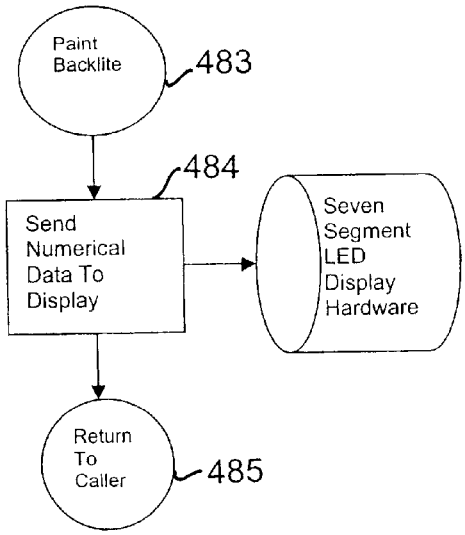
FIG. 30 sets forth a flow diagram of the control unit paint LEDs sub-routine of an alternate embodiment of the present invention bilge pump monitor and alert system.

FIG. 30 sets forth a flow diagram of the paint LED display sub-routine. Beginning at a step 483, the system moves to a step 484 in which the numerical data is communicated directly to the seven segment LED display hardware of the display unit. Once again, it will be noted that there is no RS232 communication link utilized in the alternate embodiment of FIGS. 5A and 5B. Thereafter, there system returns to the program caller at step 485.

Because display unit 190 of the alternate embodiment of the present invention set forth in FIG. 5B does not utilize a microprocessor, the flow diagrams of the control unit provide the complete program flow diagram information. Accordingly, the flow diagrams set forth in FIG. 7, FIG. 28, FIGS. 9 through 13, FIGS. 15 through 18 and FIGS. 29 and 30 provide the complete flow diagrams of the operative program within the alternate embodiment of the present invention set forth in FIGS. 5A and 5B.

What has been shown is a bilge pump monitor and alert system for boats and other vessels which monitors both bilge pump activity and high water alarm activity to provide a plurality of alarm conditions. The alarm conditions include exceeding a high water limit within a bilge compartment as well as exceeding preprogrammed limits for any bilge in terms of the number of bilge pump cycles or the time duration of any bilge pump cycle. The system is optionally programmable by the user to facilitate the establishment of independent alarm conditions within each bilge compartment optimized for the character and condition of operations within the bilge compartments. In addition, the present invention system maintains an operational history for each bilge compartment and its bilge pump which is available to the user by simple inquiry. This information is then available to the user to further adjust the alarm limit conditions for each bilge compartment and to detect potential difficulties in the bilge pump operational history.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A bilge pump monitor and alert system for use in a vessel having a plurality of bilge compartments, said system comprising:

a plurality of bilge pumps constructed for operation within vessel bilge compartments, said bilge pumps each having means for producing a pump active signal when operating;

a plurality of high water switches constructed for operation within vessel bilge compartments, said high water switches each having means for producing a high water level signal when actuated;

a control unit coupled to said plurality of bilge pumps and said high water switches receiving pump active signals and said high water level signals;

a display unit coupled to said control unit and including a control panel having a plurality of bilge pump buttons, a numeric display, a pump set button and a time set button, said display unit having means for illuminating buttons when pressed; and at least one alarm device, said control unit having means for accumulating and storing the number of times each of said bilge pumps are activated as pump count numbers and for measuring the length of time each of said pumps activate as pump time numbers and means for establishing a maximum pump count number for each of said bilge pumps and means for establishing a maximum pump time number for each of said bilge pumps and having means for activating said at least one alarm device when one of said pump count numbers equals or exceeds said maximum pump count number or one of said pump time numbers equal or exceeds said maximum pump time number, said control unit further including means for displaying said pump count number on said numeric display for a selected bilge pump when its bilge pump button is pressed.

2. The bilge pump monitor and alert system set forth in claim 1 wherein said control unit includes means for activating said at least one alarm device when any of said high water switches is activated.

3. The bilge pump monitor and alert system set forth in claim 2 wherein said control unit includes means for displaying time interval from the first operation of any of said bilge pumps.

4. A method for monitoring a bilge pump system within a boat or other vessel having a plurality of bilge compartments, said method comprising the steps of:

providing a plurality of bilge pumps operative within bilge compartments each producing a pump activation signal when activated;

providing a plurality of high water switches operative within bilge compartments each producing a high water signal when activated;

providing bilge pump selection means;

storing cumulative pump count for each bilge pump and incrementing said pump count each time the bilge pump is activated;

measuring a pump time for each bilge pump each time the bilge pump is activated;

establishing an alarm pump count for each bilge pump;

establishing an alarm pump time for each bilge pump;

producing an alarm when said pump count equals or exceeds said alarm pump count for any of said bilge pumps;

providing user-operated bilge pump selection means for each of said bilge pumps;

displaying the current cumulative pump count for each of said bilge pumps in response to said bilge pump selection means; and producing an alarm when said pump time equals or exceeds said alarm pump time for any of said bilge pumps.

5. The method set forth in claim 4 further including the step of producing an alarm when any of said high water switches is activated.

6. A bilge pump monitoring and alert system within a boat or other vessel having a plurality of bilge compartments, said system comprising:

a plurality of bilge pumps operative within bilge compartments each producing a pump activation signal when activated;

a plurality of high water switches operative within bilge compartments each producing a high water signal when activated;

means for storing cumulative pump count for each bilge pump and incrementing said pump count each time the bilge pump is activated;

means for measuring a pump time for each bilge pump each time the bilge pump is activated;

means for establishing an alarm pump count for each bilge pump;

means for establishing an alarm pump time for each bilge pump;

means for producing an alarm when said pump count equals or exceeds said alarm pump count for any of said bilge pumps;

means for providing user-operated bilge pump selection means for each of said bilge pumps;

means for displaying the current cumulative pump count for each of said bilge pumps in response to said bilge pump selection means; and means for producing an alarm when said pump time equals or exceeds said alarm pump time for any of said bilge pumps.

7. The system set forth in claim 6 further including means for producing an alarm when any of said high water switches is activated.

8. A bilge pump monitor and alert system for use in a boat or other vessel having a plurality of bilge compartments, said system comprising:

a plurality of bilge pumps each operable within a bilge compartment;

a plurality of high water switches each operable within a bilge compartment;

an alarm device;

a display unit having a plurality of bilge pump buttons and a numeric display;

a control unit coupled to said display unit, said alarm device, said high water switches and said bilge pumps and having pump sensors for sensing bilge pump operation and activation of said high water switches;

programming means, operative within said control means and responsive to said bilge pump buttons, for establishing alarm pump counts for each of said bilge pumps and for establishing alarm pump cycle times for each of said bilge pumps;

display means, operative within said control means and responsive to said bilge pump buttons, for displaying a cumulative pump count for each of said bilge pumps corresponding to the cumulative number of times each of said bilge pumps is operated; and alarm activation means, operative within said control means, for activating said alarm device when said cumulative pump count equals or exceeds said alarm pump count for any of said bilge pumps.

9. The system set forth in claim 8 wherein said alarm activation means includes means for activating said alarm device when said pump cycle time equals or exceeds said alarm pump cycle time for any of said bilge pumps.

10. The system set forth in claim 9 wherein said activation means includes means for activating said alarm device when any of said high water switches is actuated.

11. The system set forth in claim 9 wherein said activation means includes means for activating said alarm device when any of said high water switches is actuated.

12. The system set forth in claim 11 wherein said alarm device includes an audible alarm.

13. The system set forth in claim 12 wherein said alarm device includes an automatic telephone dialer.

14. The system set forth in claim 13 wherein said alarm device include a strobe light.

15. The system set forth in claim 1 wherein said system includes a non-bilge pump coupled to said control unit and having means for producing a pump active signal when operating.

16. The method set forth in claim 4 further including the steps of:

providing a non-bilge pump producing a pump activation signal;

storing a cumulative pump count for said non-bilge pump and incrementing said pump count each time said non-bilge pump is activated;

storing pump time for said non-bilge pump each time said non-bilge pump;

establishing an alarm pump count for said non-bilge pump;

establishing an alarm pump time for said non-bilge pump; and producing an alarm when either said pump count or said pump time of said non-bilge pump equals or exceeds either said alarm pump time or said alarm pump count for said non-bilge pump.

17. A bilge pump monitoring and alert system within a boat or other vessel having a plurality of bilge compartments, said system comprising:

a plurality of bilge pumps operative within bilge compartments each being detectable when activated;

a plurality of high water detectors operative within bilge compartments each being detectable when activated;

bilge pump operational history means having means for storing cumulative pump count for each bilge pump and incrementing said pump count each time the bilge pump is activated and means for measuring a pump on time for each bilge pump each time the bilge pump is activated;

user-operable means for selectively accessing each bilge pump operation history and for selectively displaying each bilge pump operational history for each selected bilge pump;

means for establishing an alarm pump count for each bilge pump;

means for establishing an alarm pump on time for each bilge pump and for comparing said pump on time to said alarm pump on time each time the bilge pump is activated;

means for producing an alarm when said pump count equals or exceeds said alarm pump count for any of said bilge pumps; and means for producing an alarm when said pump on time equals or exceeds said alarm pump time for any of said bilge pumps.

* * * * *